US010961029B2

(12) United States Patent
Klosterbuer et al.

(10) Patent No.: US 10,961,029 B2
(45) Date of Patent: Mar. 30, 2021

(54) MICRO-SPILL PREVENTION TROUGH AND METHOD OF USE

(71) Applicant: James Darwin Klosterbuer, Luverne, MN (US)

(72) Inventors: James Darwin Klosterbuer, Luverne, MN (US); Brian L. Douglass, Spicer, MN (US)

(73) Assignee: James Darwin Klosterbuer, Luverne, MN (US)

( * ) Notice: Subject to any disclaimer, the term of this patent is extended or adjusted under 35 U.S.C. 154(b) by 0 days.

(21) Appl. No.: 16/682,462

(22) Filed: Nov. 13, 2019

(65) Prior Publication Data

US 2020/0148434 A1 May 14, 2020

Related U.S. Application Data

(60) Provisional application No. 62/760,486, filed on Nov. 13, 2018.

(51) Int. Cl.
*B65D 47/40* (2006.01)
*B65D 88/02* (2006.01)

(52) U.S. Cl.
CPC ..... *B65D 47/40* (2013.01); *B65D 88/02* (2013.01)

(58) Field of Classification Search
CPC ..... B65D 47/40; B65D 88/02; B65D 23/06; B65D 23/065; B67D 7/3209; B67D 7/421; Y10T 137/5762
USPC ..... 222/108; 137/312
See application file for complete search history.

(56) References Cited

U.S. PATENT DOCUMENTS 665,937 A * 1/1901 Schneider ..... B67D 1/16 137/313
702,181 A * 6/1902 Boyd ..... B67D 1/16 222/108
1,256,206 A * 2/1918 Cordley ..... B67D 1/16 222/108
1,520,511 A * 12/1924 Reymore ..... B67D 1/16 137/313
1,702,975 A * 2/1929 Marhoff ..... F16K 23/00 137/313
2,164,666 A * 7/1939 Simmons ..... B67D 3/04 137/313
2,241,920 A * 5/1941 Peterson ..... F23D 11/36 137/315.01
5,365,968 A * 11/1994 Mills ..... F24D 19/088 137/312

(Continued)

*Primary Examiner* — Benjamin R Shaw
(74) *Attorney, Agent, or Firm* — Tarolli, Sundheim, Covell & Tummino LLP

(57) ABSTRACT

A micro-spill prevention trough and method for use in with intermediate bulk container (IBC) totes is disclosed herein. The micro-spill prevention trough includes an attachment portion rotationally coupled to fluid retention portion. The attachment portion is configured to be secured under a spout of an intermediate bulk container (IBC) tote. The attachment portion includes a bucket portion defining a fluid retention space. The fluid retaining portion defines a second fluid retention space, wherein the fluid retaining portion pivots between an open position and a closed position. In the closed position a front wall of the fluid retaining portion pivots into the bucket portion of the attachment portion to define a fluid retention container.

20 Claims, 28 Drawing Sheets

(56) References Cited

U.S. PATENT DOCUMENTS

| | | | | |
|---|---|---|---|---|
| 5,960,995 | A * | 10/1999 | Leatherman | B67D 1/16 137/313 |
| 8,172,111 | B1 * | 5/2012 | Fowler | B67C 11/02 222/108 |
| 2006/0226172 | A1 * | 10/2006 | Fowler | B67C 11/02 222/108 |
| 2009/0236364 | A1 * | 9/2009 | Njaastad | B67D 1/16 222/108 |
| 2010/0065583 | A1 * | 3/2010 | Leggett | B67D 1/16 222/108 |
| 2017/0217752 | A1 * | 8/2017 | Carryl | B67D 3/0061 |

* cited by examiner

MICRO-SPILL PREVENTION TROUGH AND METHOD OF USE

CROSS REFERENCES TO RELATED APPLICATIONS

The following application claims priority under 35 U.S.C. 119(e) to U.S. Provisional Patent Application Ser. No. 62/760,486 filed Nov. 13, 2018 entitled MICRO-SPILL PREVENTION TROUGH AND METHOD OF USE. The above-identified provisional application is incorporated herein by reference in its entirety for all purposes.

TECHNICAL FIELD

The present disclosure relates to a micro-spill prevention trough and method of use, and more particularly, micro-spill prevention trough and method of use with reusable containers designed for the transport and storage of bulk liquids.

BACKGROUND

Intermediate Bulk Container (IBC) totes 10 are reusable containers designed for the transport and storage of bulk liquids for several industries (e.g., oil & gas, food, agricultural, pharmaceutical, industrial, etc.)(see FIG. 1). Typically, IBC totes 10 are used to store and transport non-hazardous and hazardous chemicals. Such chemicals can pose serious health and safety risks. Regulations to prevent spillage and contamination from the storage and transport of hazardous materials are becoming increasingly common.

Typically, IBC tote 10 capacity is standardized in both design (e.g., typically cuboid shaped) and capacity (e.g., between 275 or 330 US gallons). The IBC totes 10 are generally configured with fill ports 12 on a top portion 16*a* and an outlet port(s) 14 on a lower portion 16*b* of the tote. The outlet port 14 generally has a 2" bulk-head connection stub 15 and is comprised of a valve 13 and standard threaded or cam-lock fitting connection 17. The valve 13 and stub 15 connections 17 tend to leak over time and bases 18 of the IBC tote 10 are not designed to contain spills. The tendency for fitting leakage and increased regulation presents a real need for micro spill containment solutions which are adaptable to most standard IBC totes 10.

SUMMARY

One example embodiment of the present disclosure includes a micro-spill prevention trough for with intermediate bulk container (IBC) totes comprising an attachment portion configured to be secured under a spout of an intermediate bulk container (IBC) tote, the attachment portion comprising a bucket portion defining a fluid retention space, and a fluid retaining portion defining a second fluid retention space rotationally coupled to the attachment portion, wherein the fluid retaining portion pivots between an open position and a closed position, wherein in the closed position a front wall of the fluid retaining portion pivots into the bucket portion of the attachment portion to define a fluid retention container.

Another example embodiment of the present disclosure includes a method of making a micro-spill prevention trough for use with intermediate bulk container (IBC) totes, the method comprising the steps of: forming an attachment portion configured to be secured under a spout of an intermediate bulk container (IBC) tote, forming a bucket portion defining a fluid retention space within the attachment portion, and forming a fluid retaining portion having a front wall defining a second fluid retention space. The method further includes the step of rotationally coupling to the attachment portion to the fluid retaining portion such that the fluid retaining portion pivots between an open position and a closed position, wherein in the closed position the front wall of the fluid retaining portion pivots into the bucket portion of the attachment portion to define a fluid retention container.

Yet another example embodiment of the present disclosure includes a micro-spill prevention trough for use with intermediate bulk container (IBC) totes comprising an attachment portion configured to be secured under a spout of an intermediate bulk container (IBC) tote. The attachment portion compromises a bucket portion defining a fluid retention space, wherein the bucket portion comprises an interface lip and a wall that increases in height as the wall extends away from the bucket portion, the wall defining an interior space of the attachment portion. The micro-spill prevention trough further includes a fluid retaining portion defining a second fluid retention space. The fluid retraining portion comprising a capture area defined by a base wall, first and second sidewalls, a front wall, and a rear wall, and a flow direction path, wherein the flow direction path is defined by portions of the front wall, the base wall, and the first and second sidewalls. Wherein, the fluid retaining portion is rotationally coupled to the attachment portion, wherein the fluid retaining portion pivots between an open position and a closed position, in the closed position the front wall of the fluid retaining portion pivots into the bucket portion of the attachment portion to define a fluid retention container, wherein the interface lip interacts with the fluid retaining portion to further define the flow direction path.

BRIEF DESCRIPTION OF THE DRAWINGS

The foregoing and other features and advantages of the present disclosure will become apparent to one skilled in the art to which the present invention relates upon consideration of the following description of the invention with reference to the accompanying drawings, wherein like reference numerals refer to like parts unless described otherwise throughout the drawings and in which.

Figure 1:
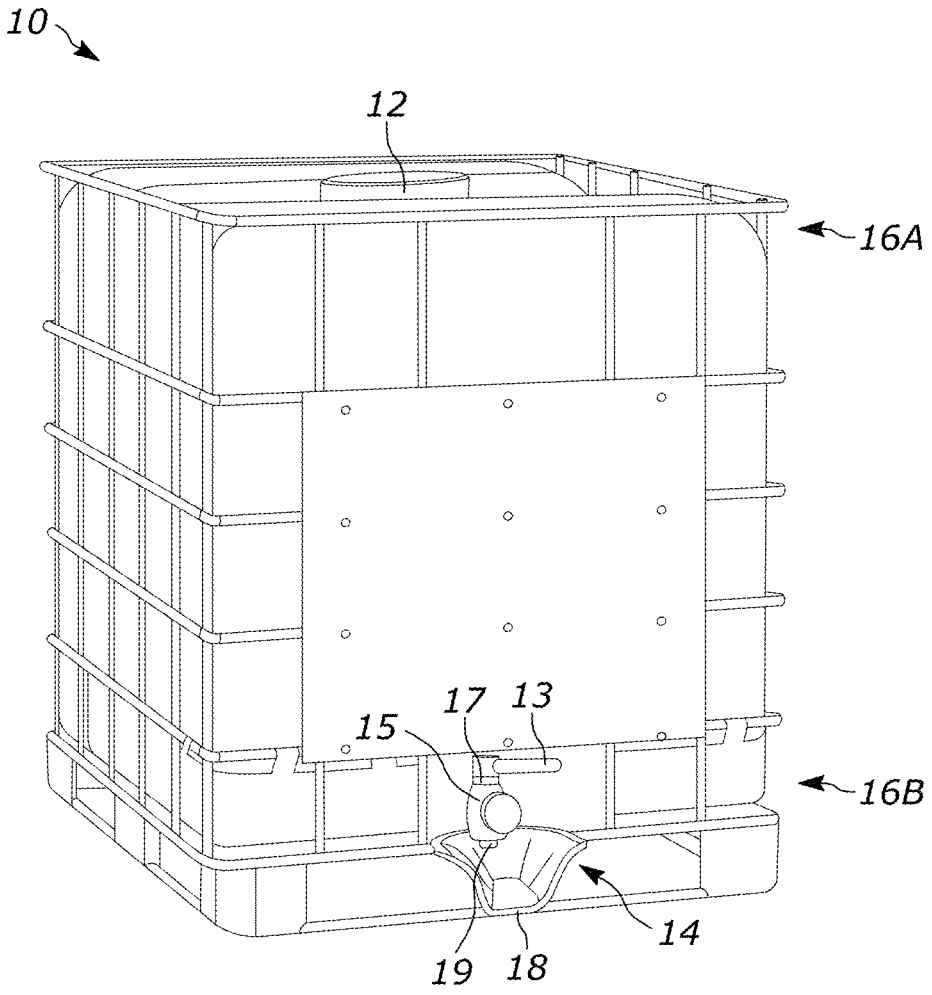
(PRIOR ART) FIG. 1
FIG. 1 is a perspective view of a prior art example Intermediate Bulk Container (IBC) tote.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements throughout unless otherwise noted. The present disclosure relates to a micro-spill prevention trough and method of use, and more particularly, micro-spill prevention trough and method of use with reusable containers designed for the transport and storage of bulk liquids.

Figure 2:
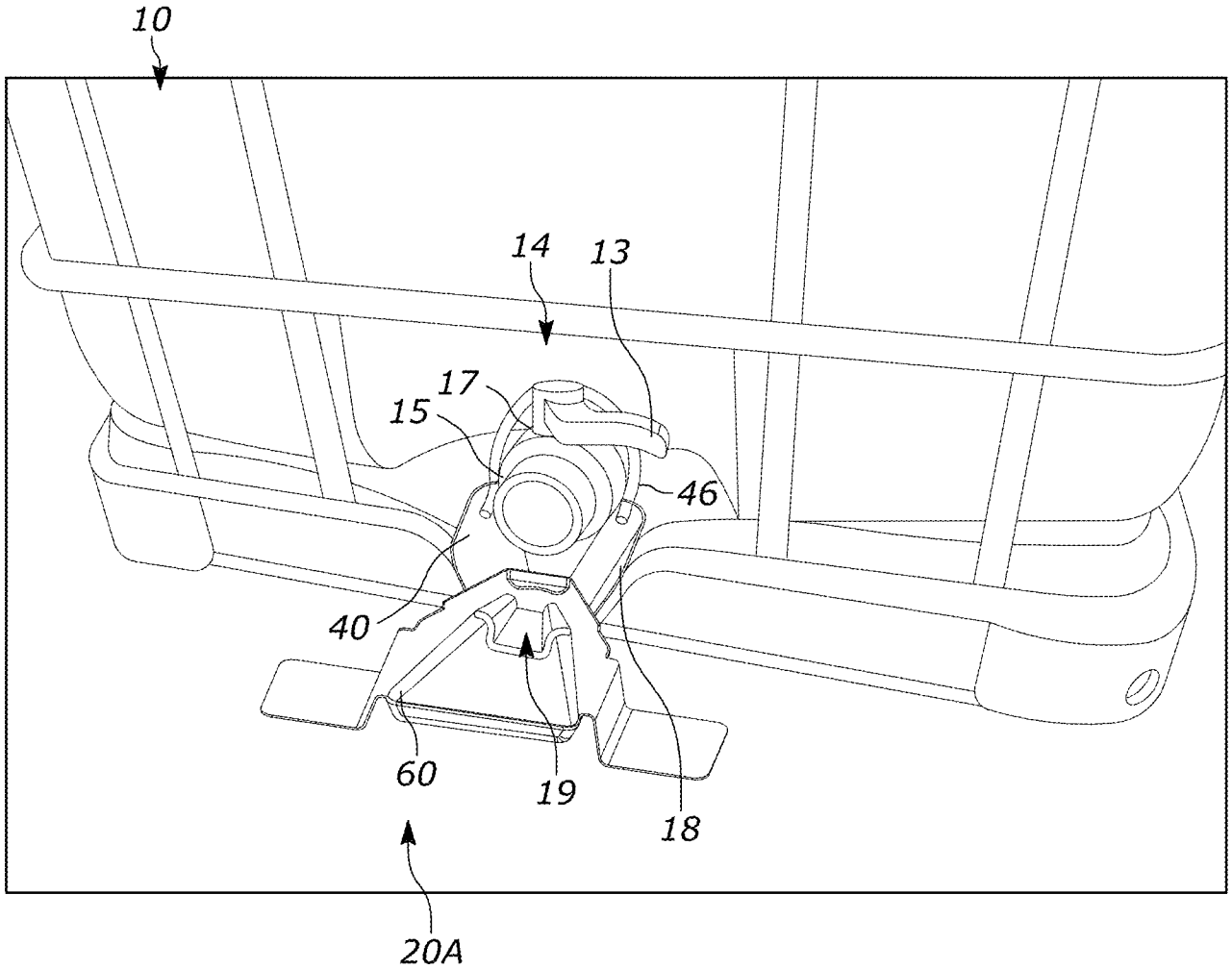
FIG. 2 is a perspective view of a spill prevention trough in an open position coupled to an IBC tote in accordance with one example embodiment of the present disclosure.
Figure 7:
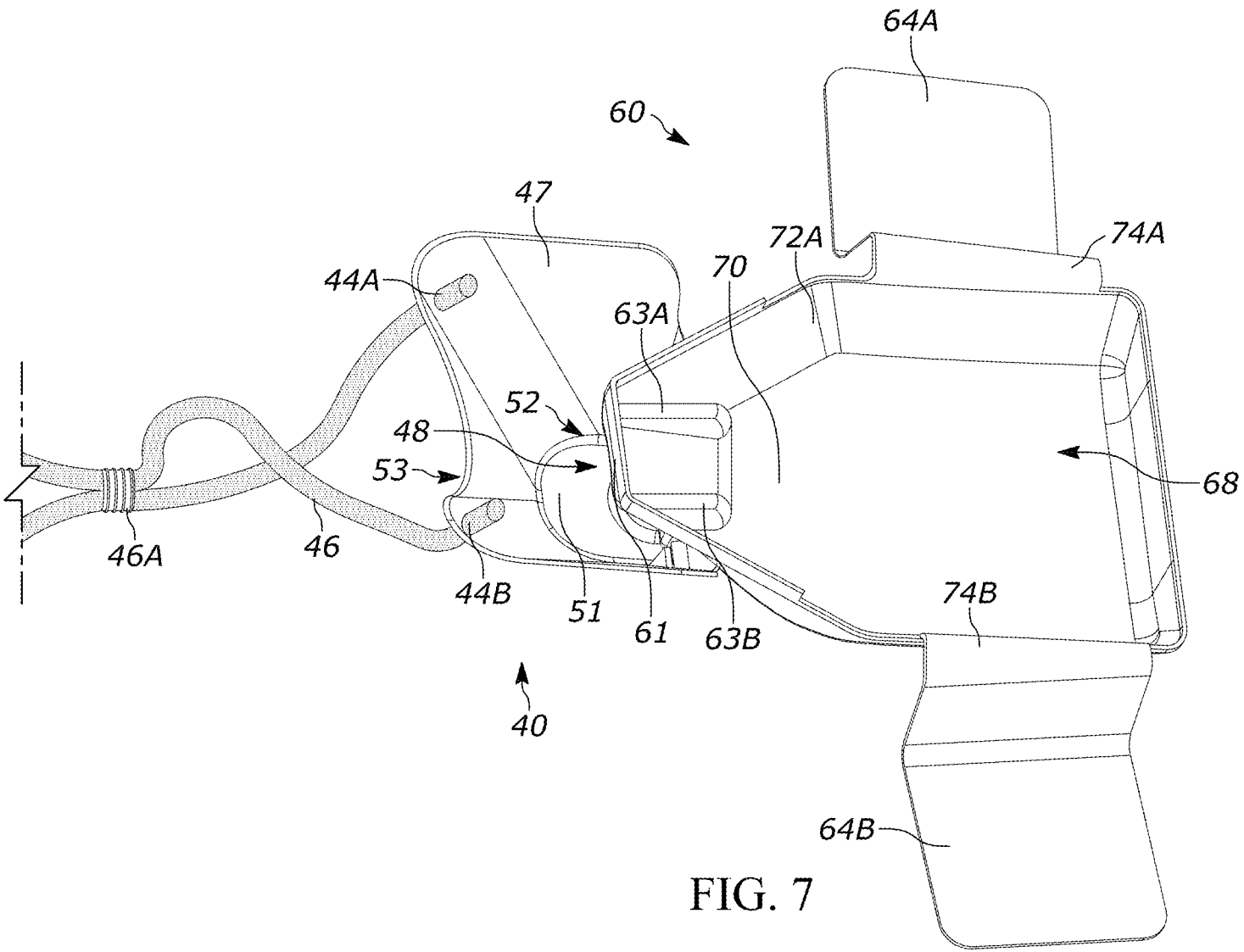
FIG. 7 is a front perspective view of a spill prevention trough in an open position in accordance with one example embodiment of the present disclosure.

FIG. 2 illustrates an example embodiment of a micro-spill prevention trough 20 in an open position 20*a*. The micro-spill prevention trough 20 is positioned under an outlet port 14. In one example embodiment, the micro-spill prevention trough 20 is positioned over an IBC tote base 18. A securing apparatus 46 is positioned over the outlet port 14 to secure an attachment portion 40 of the micro-spill prevention trough 20 underneath the outlet port 14 (including the valve 13 and stub 15 connections 17) and a fluid retaining portion 60 of the micro-spill prevention trough 20 is positioned underneath a spout 19 (e.g., the location fluid is dispensed). The micro-spill prevention trough 20 is removable and transferable between multiple IBC totes 10. In the example embodiment illustrated in FIG. 7, the securing apparatus 46 includes a tightening mechanism 46*a* that secures the micro-spill prevention trough 20 in position during use. In one example embodiment, the tightening portion 46*a* comprises a friction slide, a clip, a chord lock, etc. It would be appreciated by one having ordinary skill in the art that the securing apparatus 46 includes rubber, plastic and/or textile chords that can be secured in many ways including through knotting, buckle, friction, etc. The securing apparatus 46 comprises at least one of flexible polymer and/or plastic material.

In one example embodiment, the attachment portion 40 and/or the fluid retaining portion 60 comprise one of metal, plastic, polymeric material, and/or some combination thereof. In another example embodiment, the attachment portion 40 and/or the fluid retaining portion 60 are made by injection molding, by hand, by molds, or the like.

Figure 3:
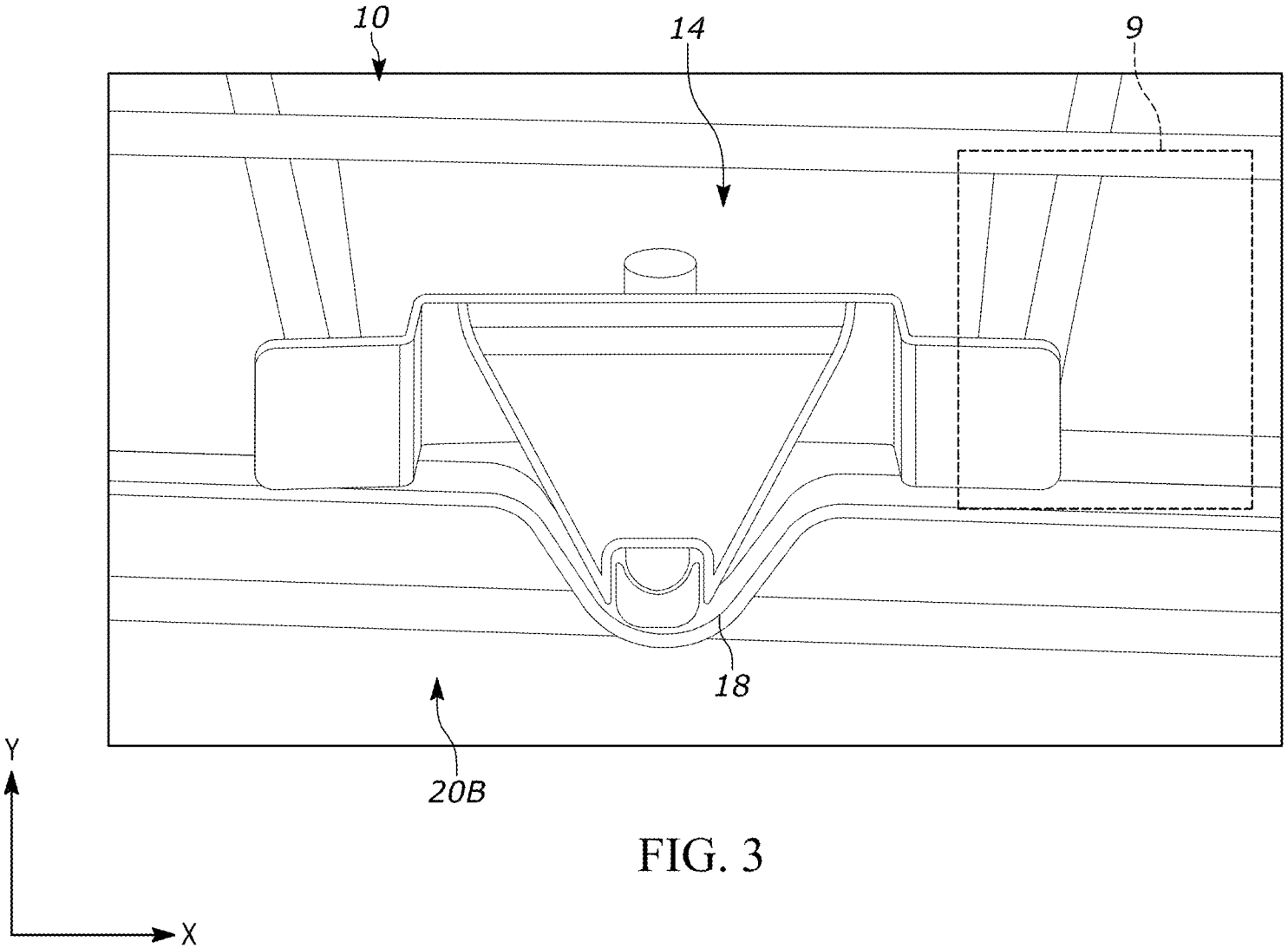
FIG. 3 is a perspective view of a spill prevention trough in a closed position coupled to an IBC tote in accordance with another example embodiment of the present disclosure.
Figure 9:
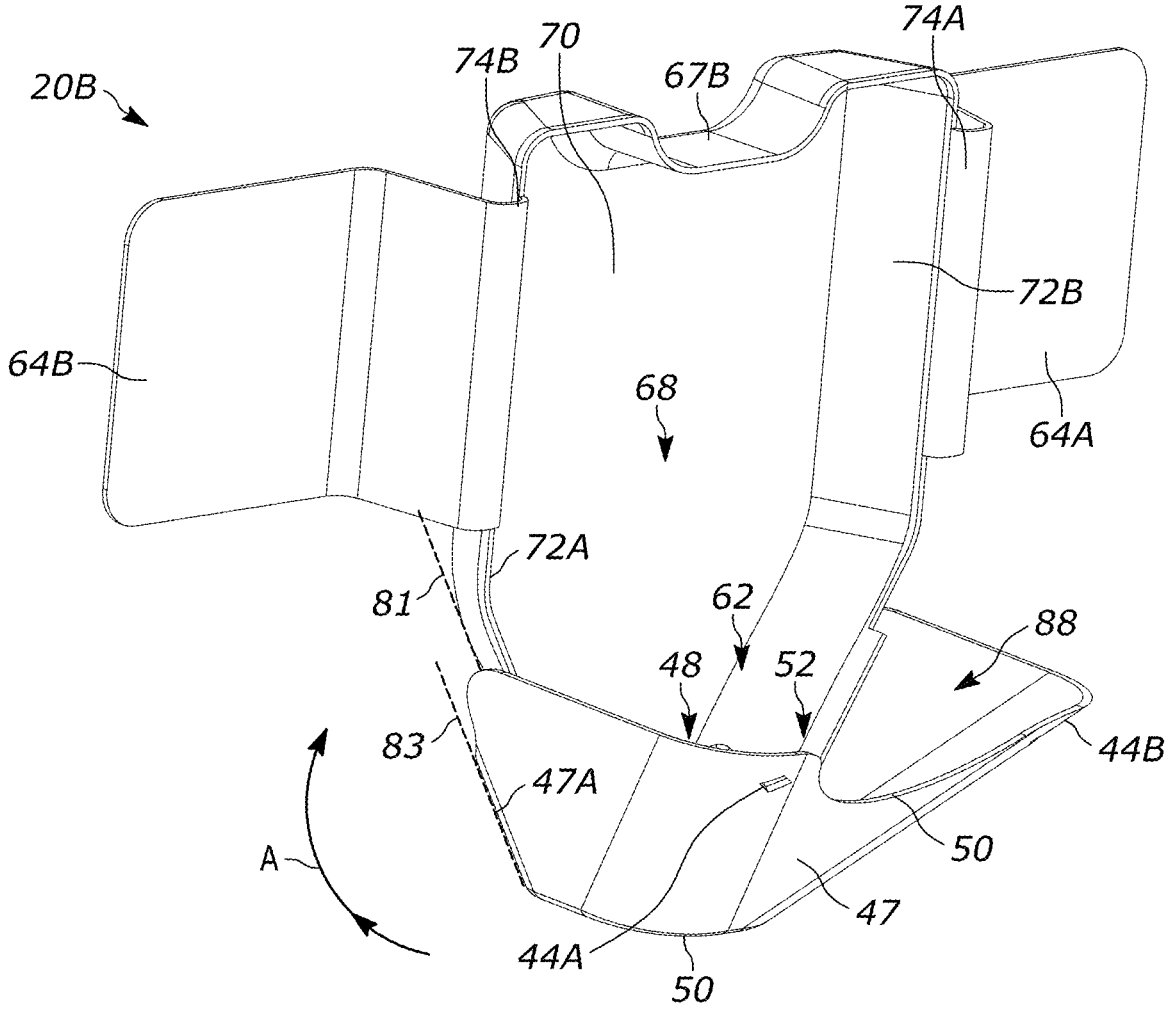
FIG. 9 is a front perspective view of a spill prevention trough in a closed position in accordance with one example embodiment of the present disclosure.

FIG. 3 illustrates an example embodiment of the micro-spill prevention trough 20 in a closed position 20*b*. The securing apparatus 46 is positioned over the outlet port 14 to secure the attachment portion 20 underneath the outlet port 14. In the illustrated example embodiment of FIG. 3, the fluid retaining portion 40 is rotationally pivoted into the closed position 20*b* (in direction A, see FIG. 9) from the open position 20*a*. In the closed position 20*b*, the fluid retaining portion 40 does not interact with or extend past walls of the IBC tote 10 and/or the base 18 that extend along a plane 9 extending along the x and y directions. Stated another way, in the closed position 20*b*, the micro-spill prevention trough 20 does not protrude relative to the IBC tote 10.

Figure 4B:
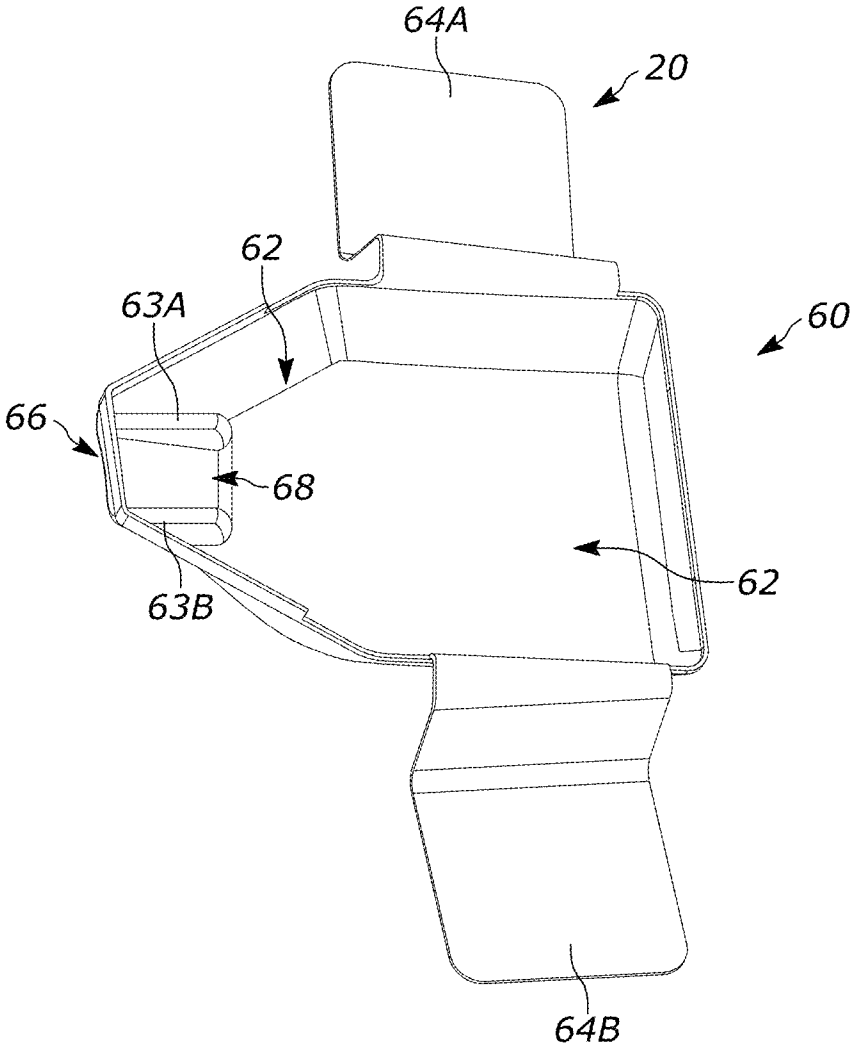
FIG. 4B is a perspective view of a fluid retaining portion of a spill prevention trough in accordance with one example embodiment of the present disclosure.
Figure 4A:
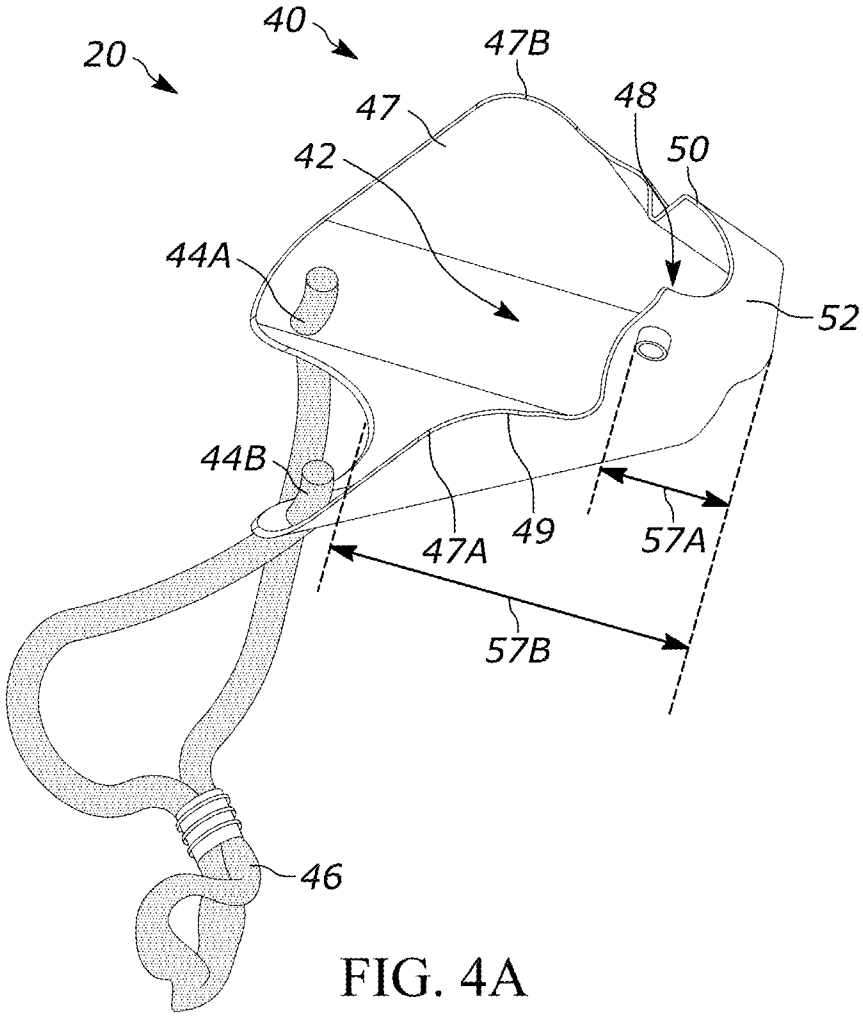
FIG. 4A is a perspective view of an attachment portion of a spill prevention trough in accordance with one example embodiment of the present disclosure.
Figure 5:
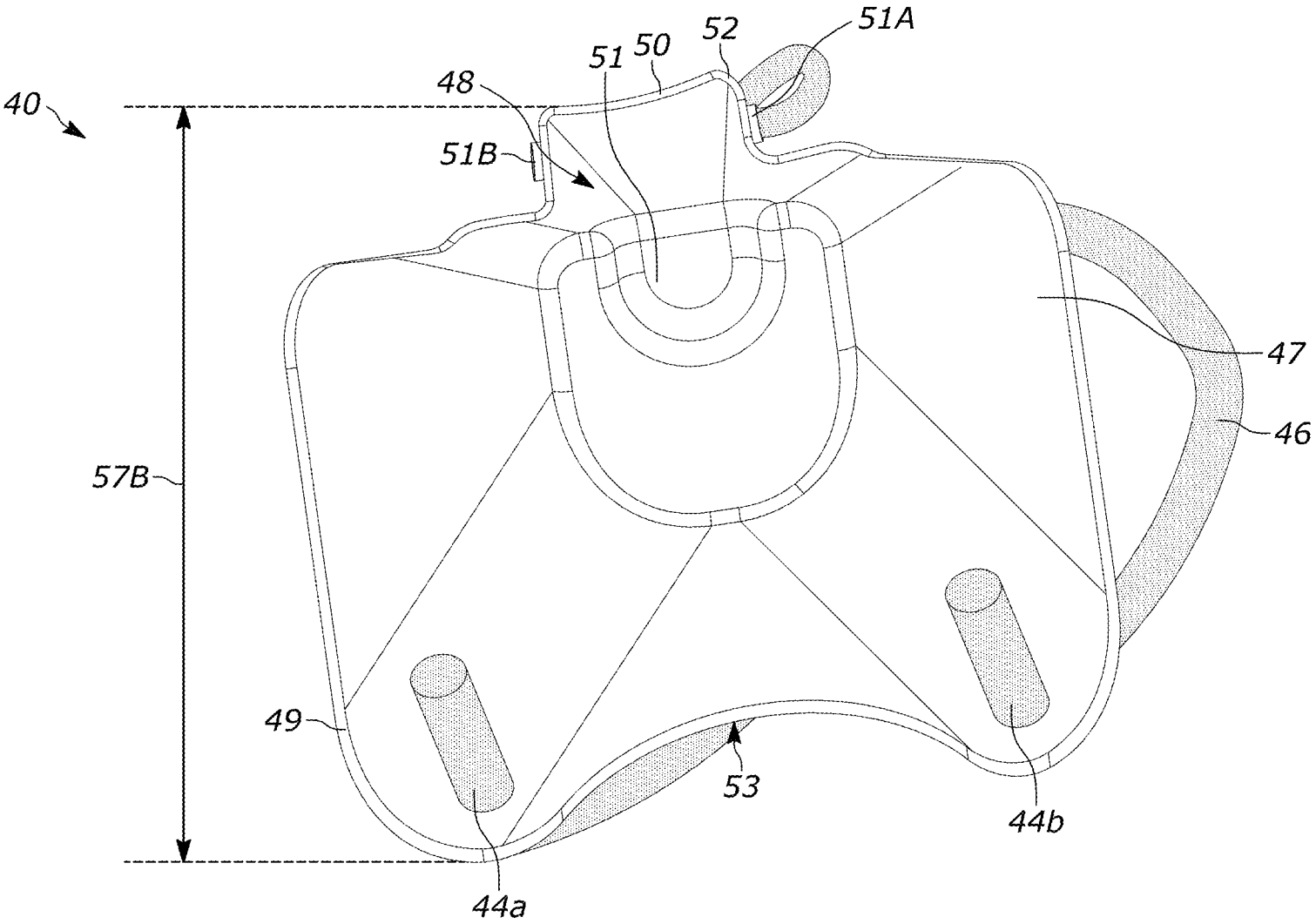
FIG. 5 is a top perspective view of an attachment portion of a spill prevention trough in accordance with one example embodiment of the present disclosure.

In the illustrated example embodiment of FIGS. 4A and 5, the attachment portion 40 is decoupled from the fluid retaining portion 60. In the illustrated example embodiment, the attachment portion 40 is configured to fit within the base 18. The attachment portion 40 comprises a bucket portion 52 defining a fluid retention space 48. The bucket portion 52 comprises an interface lip 50 that supports and interacts with the fluid retaining portion 60 when the attachment portion 40 is coupled thereto. The bucket portion 52 further comprises a substantially flat bottom surface 51 (see, for example, FIG. 7). Wherein the bucket portion 52 has a first height 57*a*, not including the interface lip 50, and a wall 47 has an increasing height, at least one of linearly, step-wise, or in an arced manner from the first height to a second height 57*b* (see FIG. 5) measured from an edge 49 of the wall to the flat bottom surface 51. In one example embodiment, the flat bottom surface 51 extends along a first axis that is parallel to a surface on which the tote 10 rests when in use.

In the illustrated example embodiment of FIG. 5, first and second protrusions 51*a*, 51*b*, extend from the bucket portion 52. The first and second protrusions 51*a*, 51*b* interface with first and second voids 84*a*, 84*b* (see FIG. 8) of the fluid retaining portion 60 to rotationally couple the attachment portion 40 to the fluid retaining portion. As illustrated in the example embodiment of FIGS. 8, 10, the first and second voids 84*a*, 84*b* define openings and/or indentations that are complementary to the first and second protrusions 51*a*, 51*b*. In one example embodiment, the first and second protrusions 51*a*, 51*b* are linked by a pin through the first and second voids 84*a*, 84*b*, or by some other rotational mechanism. In another example embodiment, the first and second protrusions 51*a*, 51*b* are frictionally fit within the first and second voids 84*a*, 84*b*, allowing for rotational movement of the attachment portion 40 and the fluid retaining portion 60 relative to each other.

As illustrated in the example embodiment of FIG. 4A, extending from the bucket portion 52 and/or the flat bottom surface 51 is the wall 47, having first and second edges 47*a*, 47*b*, that define an interior space 42 of the attachment portion 40. The first and second edges 47*a*, 47*b* interface with first and second sidewalls 72*a*, 72*b* of the fluid retaining portion 60 (see FIGS. 6 and 8) when the micro-spill prevention trough 20 is in the closed position 20*b*.

As illustrated in the example embodiment of FIG. 5, the wall 47 defines first and second securing locations 44*a*, 44*b* through which the securing apparatus 46 is secured and/or attached. In the example embodiment, the first and second securing locations 44*a*, 44*b* are laterally spaced from one another by a spout engagement notch 53. The spout engagement notch 53 is configured to interact with an underside of the outlet port 14, such that portions of the wall 47 having first and second securing locations 44*a*, 44*b* extend beyond a drip location of the outlet port. It would be appreciated by one having ordinary skill in the art that first and second securing locations 44*a*, 44*b* could be located in multiple locations.

Figure 8:
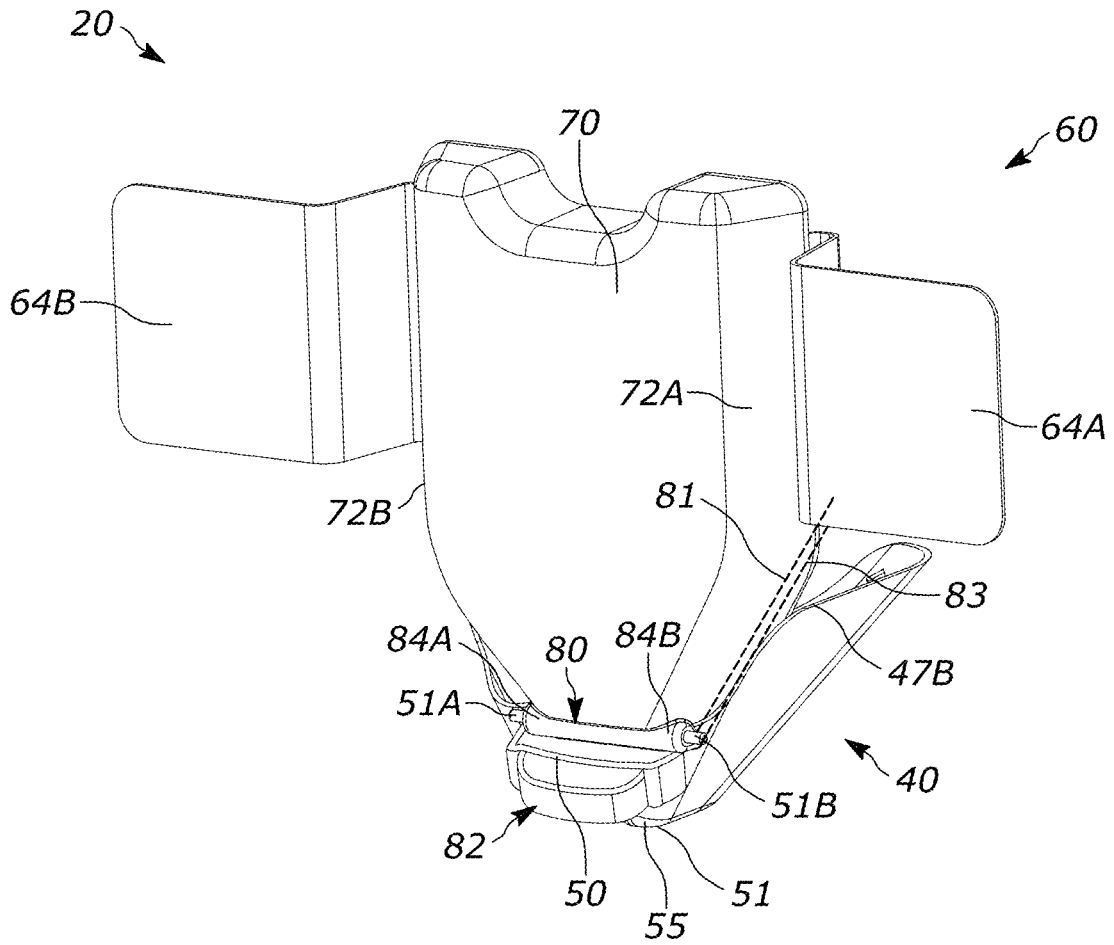
FIG. 8 is a rear perspective view of a spill prevention trough in an open position in accordance with one example embodiment of the present disclosure.
Figure 10:
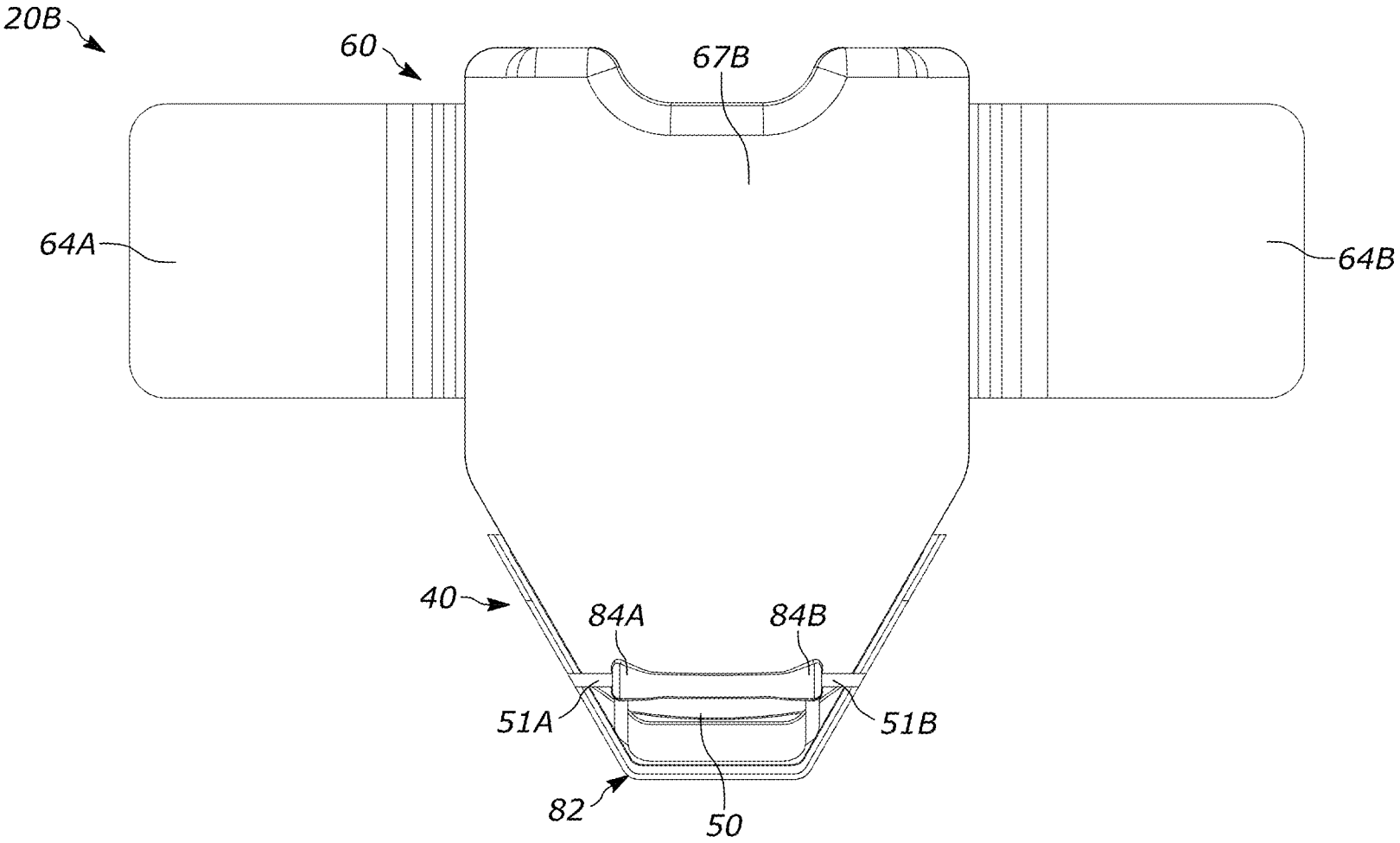
FIG. 10 is a rear perspective view of a spill prevention trough in a closed position in accordance with one example embodiment of the present disclosure.
Figure 11:
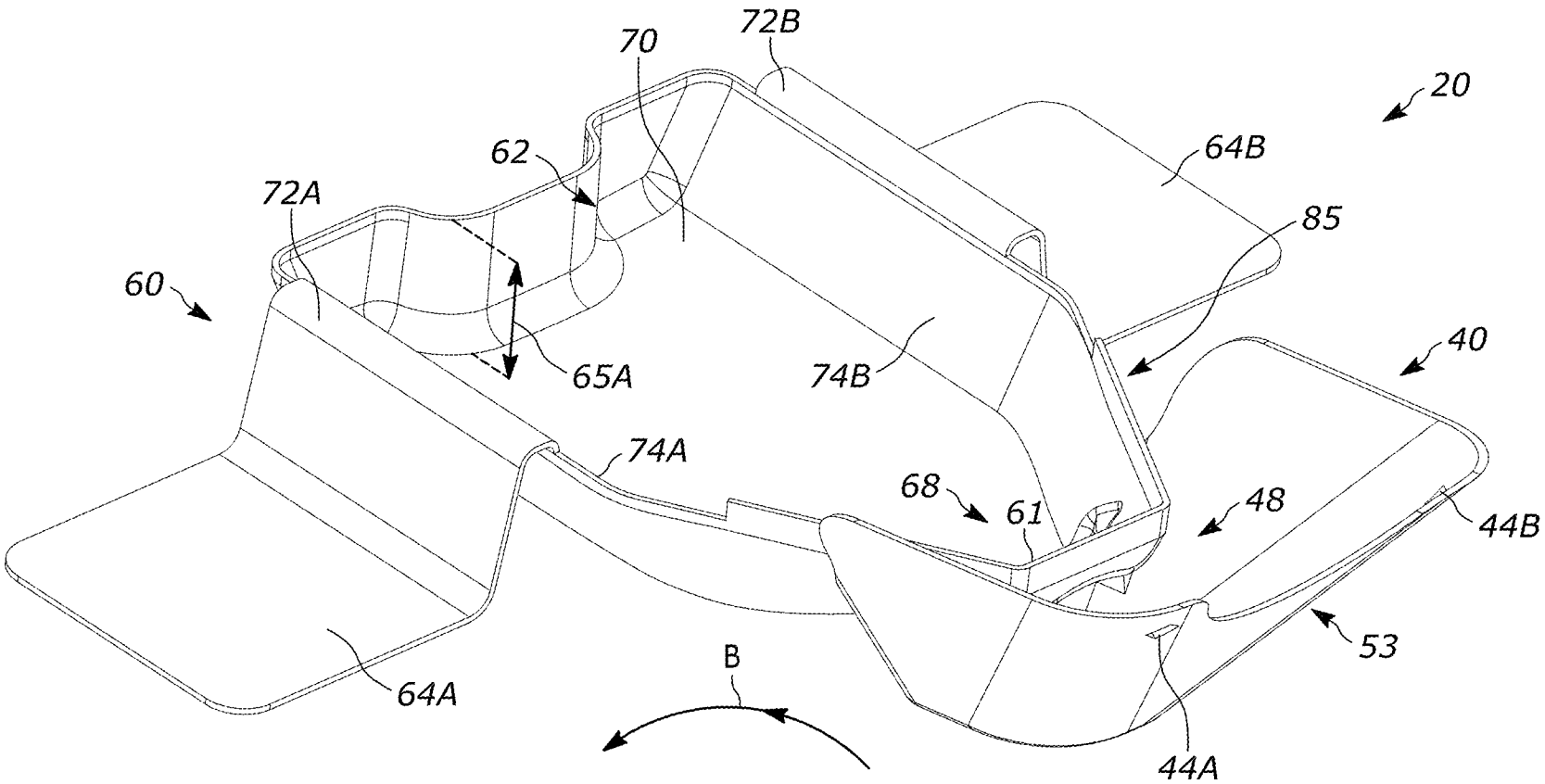
FIG. 11 is a front left perspective view of a spill prevention trough in an open position in accordance with one example embodiment of the present disclosure.

In the illustrated example embodiment of FIGS. 8 and 10, the attachment portion 40 includes a loop or protrusion 82 on an exterior face of the bucket portion 52. The loop or protrusion 82 is one of a support mechanism for the fluid retaining portion 60 when the micro-spill prevention trough 20 is assembled and in the open 20*a* position (e.g., such as when the fluid retaining portion 60 is rotationally moved away from the attachment portion 40 in direction B, see FIG. 11).

Figure 6:
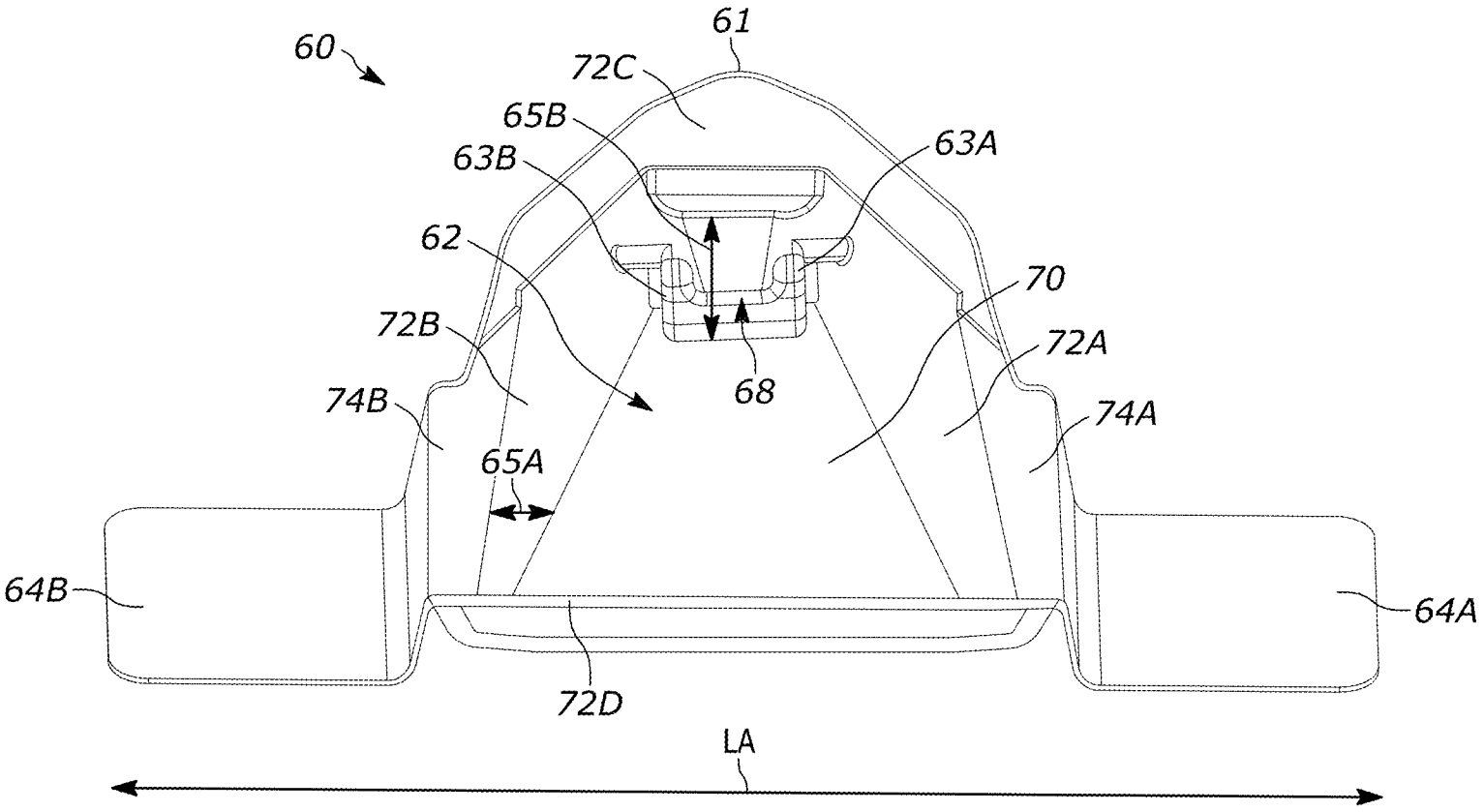
FIG. 6 is a top perspective view of an fluid retaining portion of a spill prevention trough in accordance with one example embodiment of the present disclosure.
Figure 12:
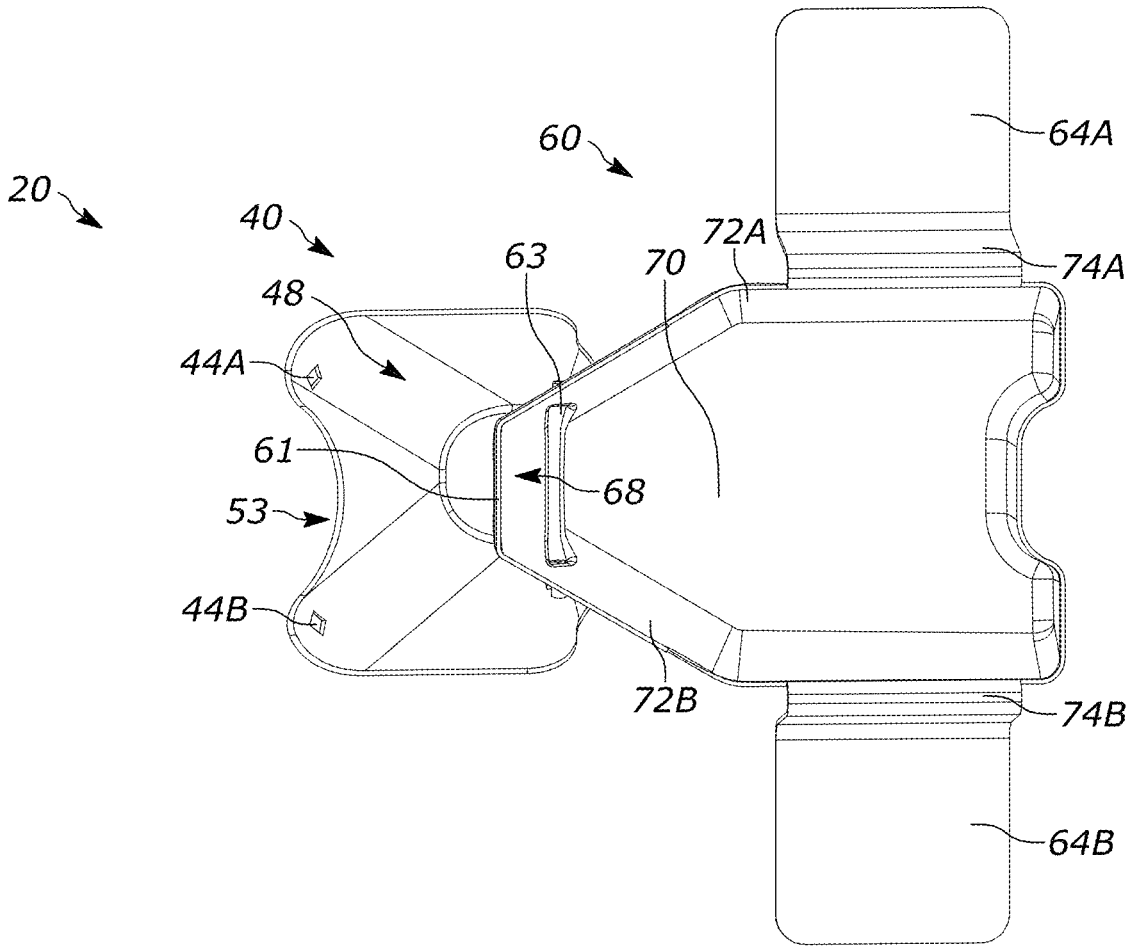
FIG. 12 is a top front perspective view of a spill prevention trough in an open position in accordance with one example embodiment of the present disclosure.
Figure 13:
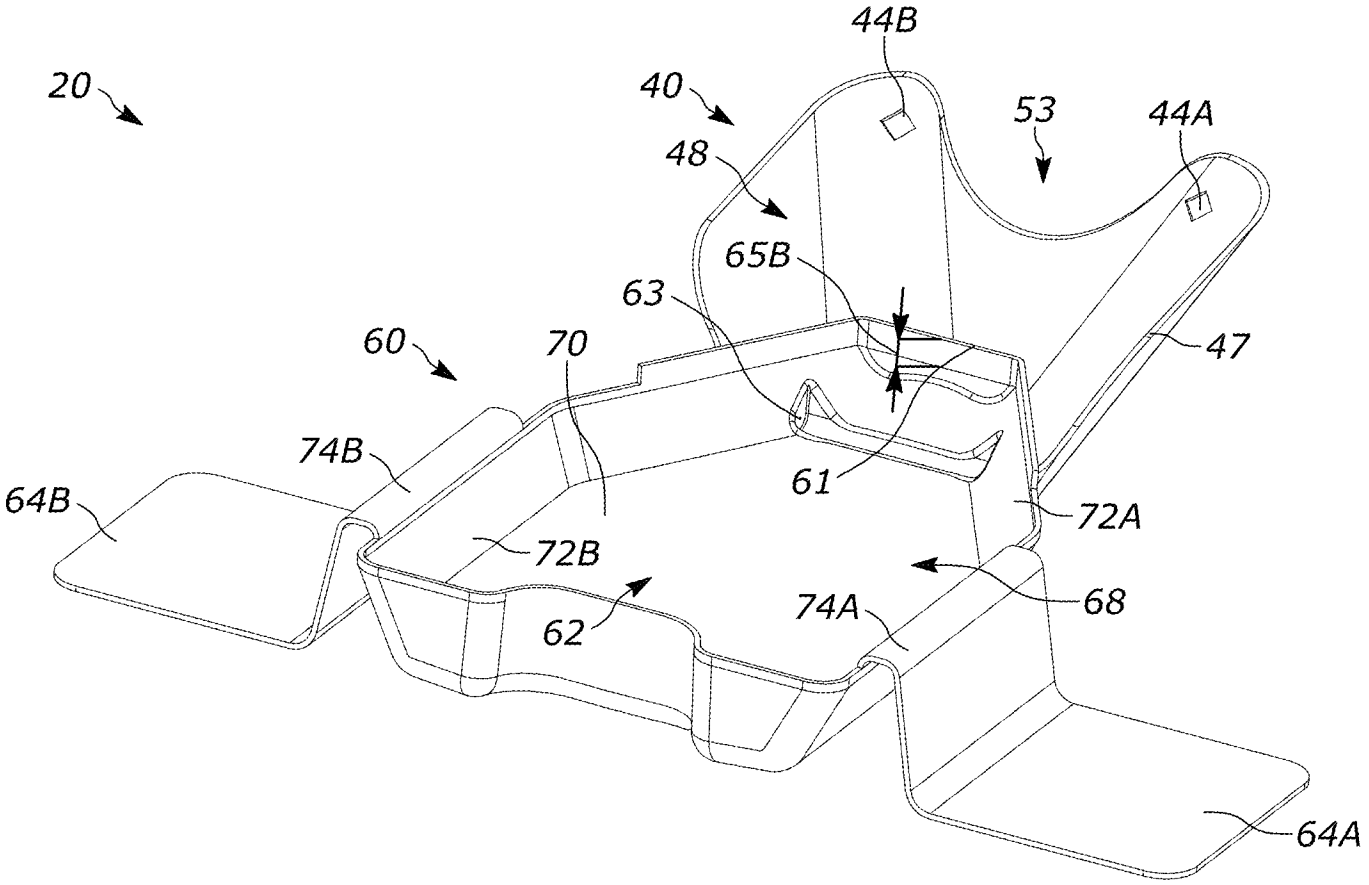
FIG. 13 is a rear perspective view of a spill prevention trough in an open position in accordance with one example embodiment of the present disclosure.

In the illustrated example embodiment of FIGS. 4B and 6, the fluid retaining portion 60 is illustrated decoupled from the attachment portion 40. The fluid retaining portion comprises a fluid capture area 62 defined by a base wall 70, first and second sidewalls 72*a*, 72*b*, a front wall 72*c*, and a rear wall 72*d*. The front wall 72*c* includes a portion of a flow direction path 68 and indents 63*a*, 63*b* on an interior portion that correspond to a connection interaction location of the first and second voids and the first and second protrusions 51*a*, 51*b* that is formed on an external portion of the front wall. In another embodiment, such as illustrated in FIGS. 12-13, a single indent 63 is on an interior portion of the front wall 72*c*.

In one example embodiment, the flow direction path 68 comprises portions of the front wall 72*c*, the base wall 70, and the first and second sidewalls 72*a*, 72*b*. The flow direction path 68 comprises an area wherein the base wall 70 begins to narrow as it extends toward the front wall 72*c*. In one example embodiment, the front wall 72*c* has a front protrusion 61 that extends above a linear edge of the front wall. In another example embodiment, a rear length 65*a* of the rear wall 72*d* (see FIG. 11) measured from the base wall 70 to an edge of the rear wall farthest from the base wall is less than a front length 65*b* (see FIG. 6) measured from the wall 70 to an edge of the front wall farthest from the base wall. In that embodiment, fluid that is captured by the fluid containing portion 60 flows toward the front wall 72*c* when the micro-spill prevention trough 20 is in use. In another example embodiment, the front length 65*b* is substantially the same as the rear length 65*a*.

Figure 14:
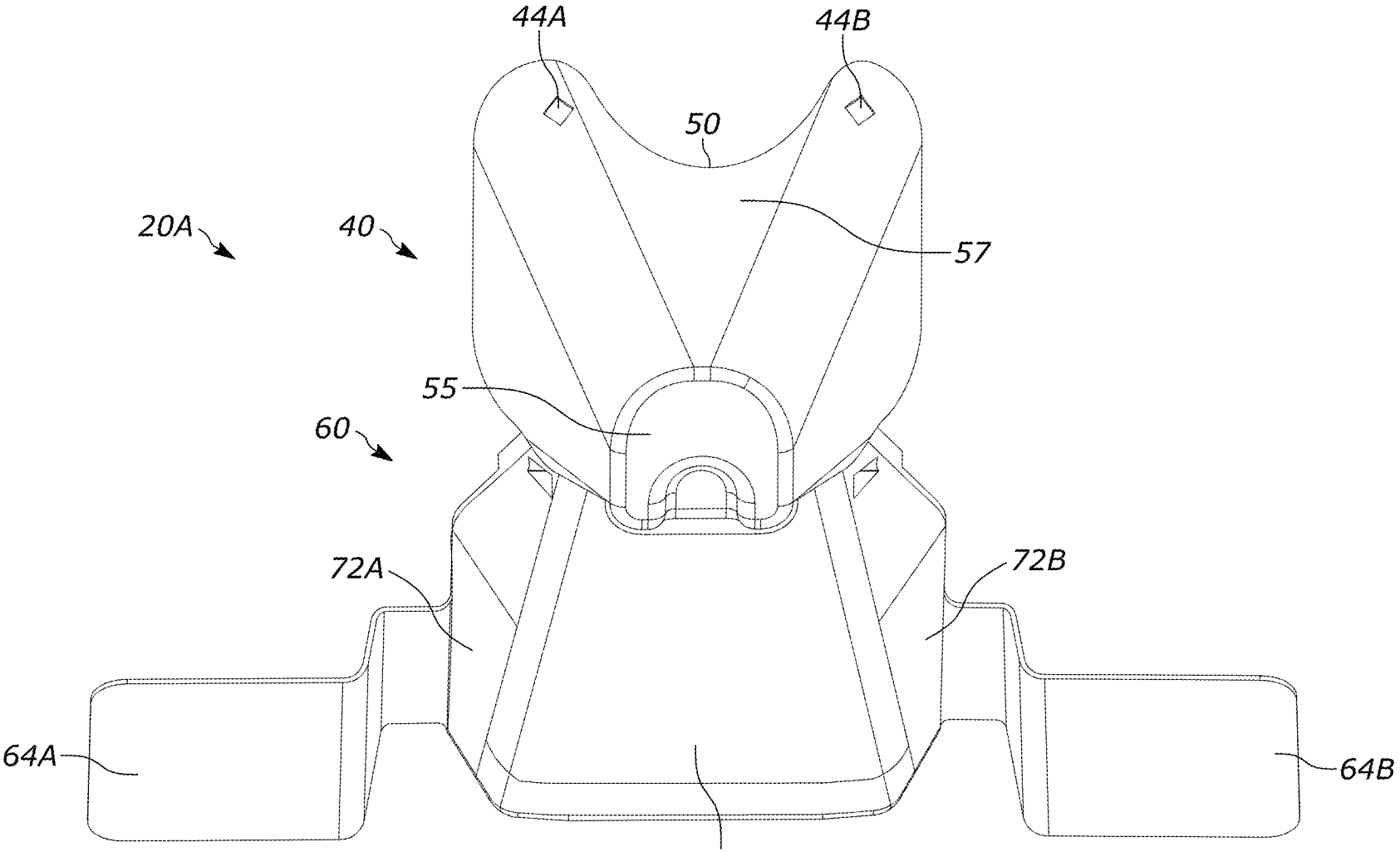
FIG. 14 is a rear perspective view of a spill prevention trough in an open position in accordance with another example embodiment of the present disclosure.

In the illustrated example embodiment of FIGS. 4B-17, the first and second sidewalls 72*a*, 72*b* are coupled to wing supports 74*a*, 74*b* respectively. The wing supports 74*a*, 74*b* support first and second wings 64*a*, 64*b*, respectively. In one example embodiment, the first and second wings 64*a*, 64*b* are one of substantially parallel to the base wall 70, substantially parallel to each other, are located between a plane along which the base wall extends and an edge of the first or second sidewall 72*a*, 72*b*, and/or located farthest from the base wall. The wings 64*a*, 64*b* provide a handle or human interaction point to open and close the micro-spill prevention trough 20. In the illustrated example embodiment, the wings 64 comprise a honeycomb pattern or some other pattern, wherein raised portions overlay a flat surface to trap liquid. In another example embodiment, the wings 64 comprise an interrupted honeycomb or other shape pattern that transverse the material comprising the wings to define one or more openings in the wings (see, for example, FIG. 14).

In the illustrated example embodiments of FIGS. 7, 11-14, the micro-spill prevention trough 20 is illustrated, wherein the attachment portion 40 and the fluid retaining portion 60 are rotationally coupled together in the open 20*a* position. The attachment portion 40 is coupled to an exterior portion of the fluid retaining portion 60 as described above with regard to the connection interaction location 85. The front wall 72*c* and at least a portion of the sidewalls 72*a*, 72*b* of the fluid retaining portion 60 are located over the attachment portion 40 in the open position 20*a*, such that if fluid overflowed the front wall, the liquid would be caught in the bucket portion 52.

In the illustrated example embodiments, portions of the first and second edges 47*a*, 47*b* of the wall 47 of the attachment portion 40 are adjacent to, or near the sidewalls 72*a*, 72*b* of the fluid retaining portion 60. In the open position 20*a*, the bucket portion 52 is under the connection 17 and the valve 13, when in use. If the connection leaks, the attachment portion 40 will capture and retain the liquid. Further, when in the open position 20*s*, the fluid retaining portion 60 is under the spout 19 and will capture and retain leakage therefrom.

Figure 15:
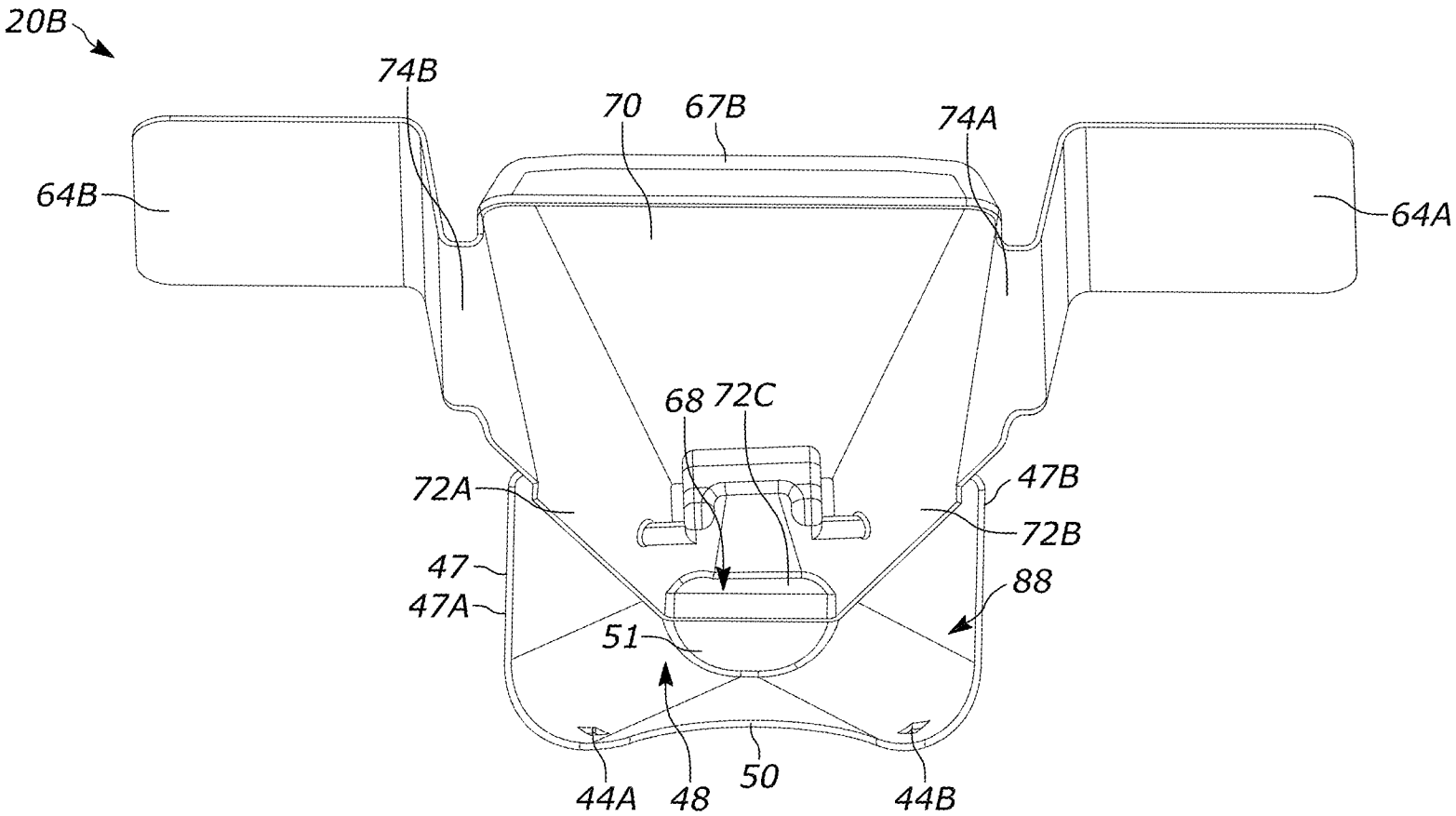
FIG. 15 is a front perspective view of a spill prevention trough in a closed position in accordance with one example embodiment of the present disclosure.
Figure 16:
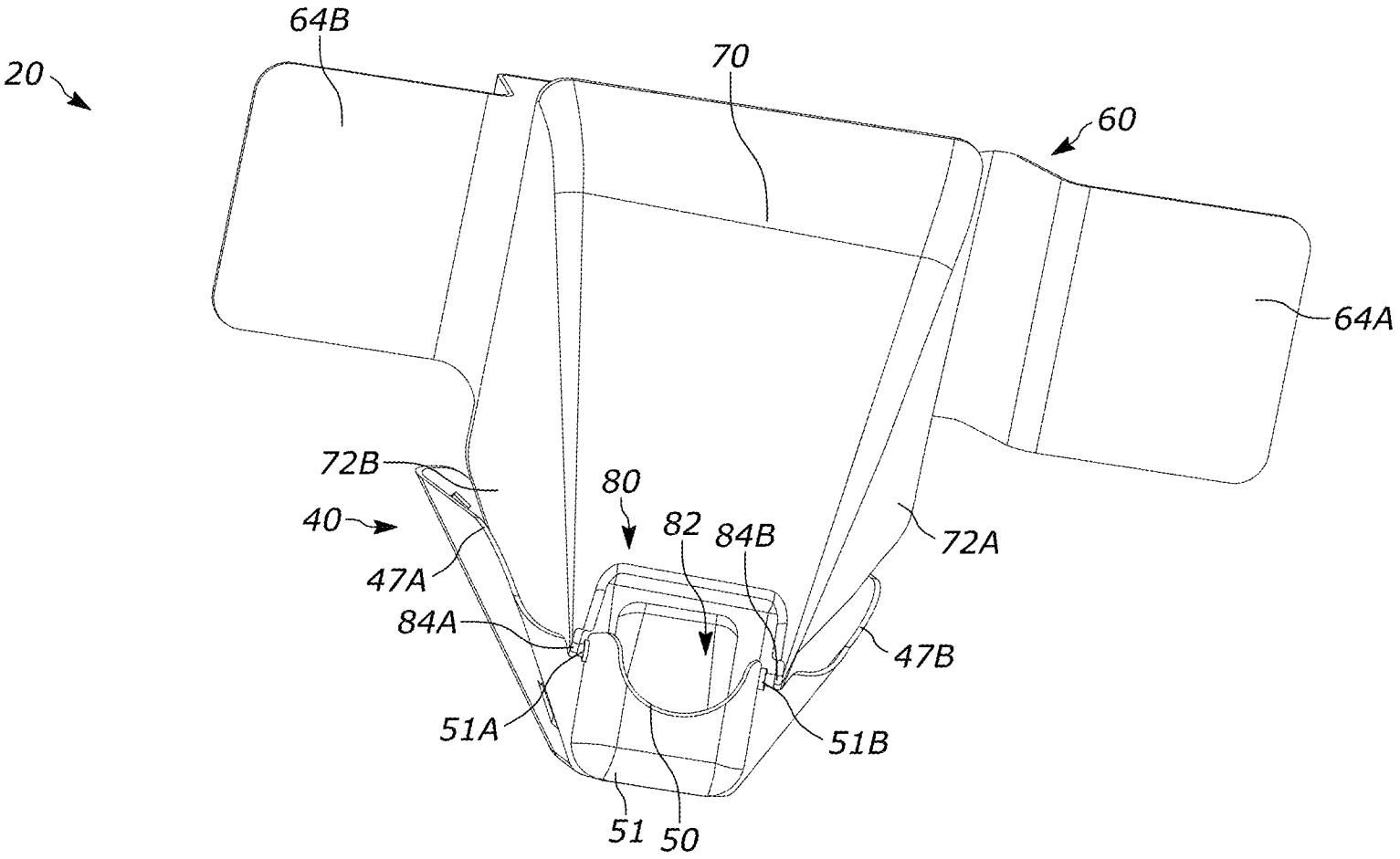
FIG. 16 is a rear perspective view of a spill prevention trough in a closed position in accordance with another example embodiment of the present disclosure.
Figure 17:
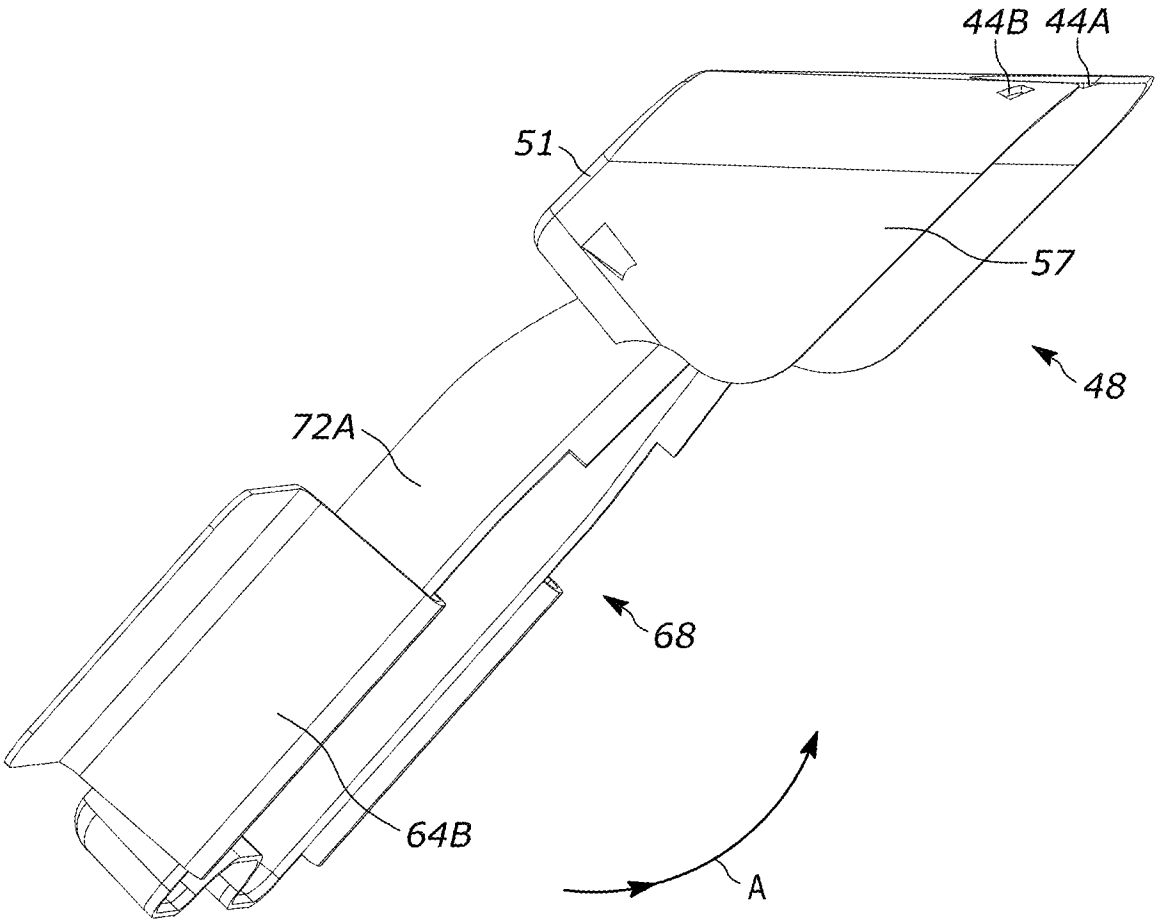
FIG. 17 is a side perspective view of a spill prevention trough in an open position in accordance with another example embodiment of the present disclosure.
Figure 18:
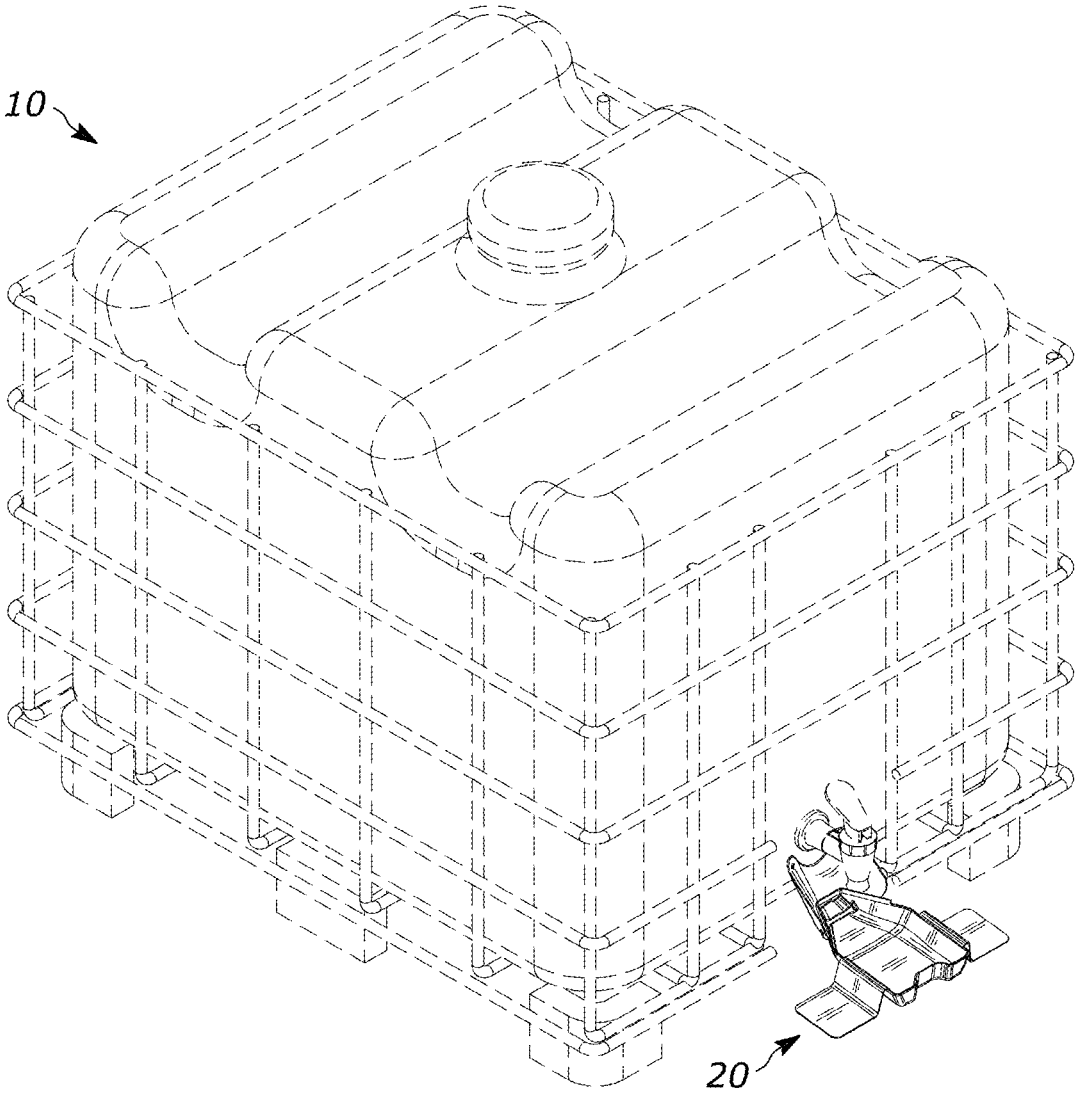
FIG. 18 is a top left perspective view of a MICRO-SPILL PREVENTION TROUGH in an open position coupled to an Intermediate Bulk Container Tote shown in phantom in accordance with one example embodiment of the present disclosure.
Figure 19:
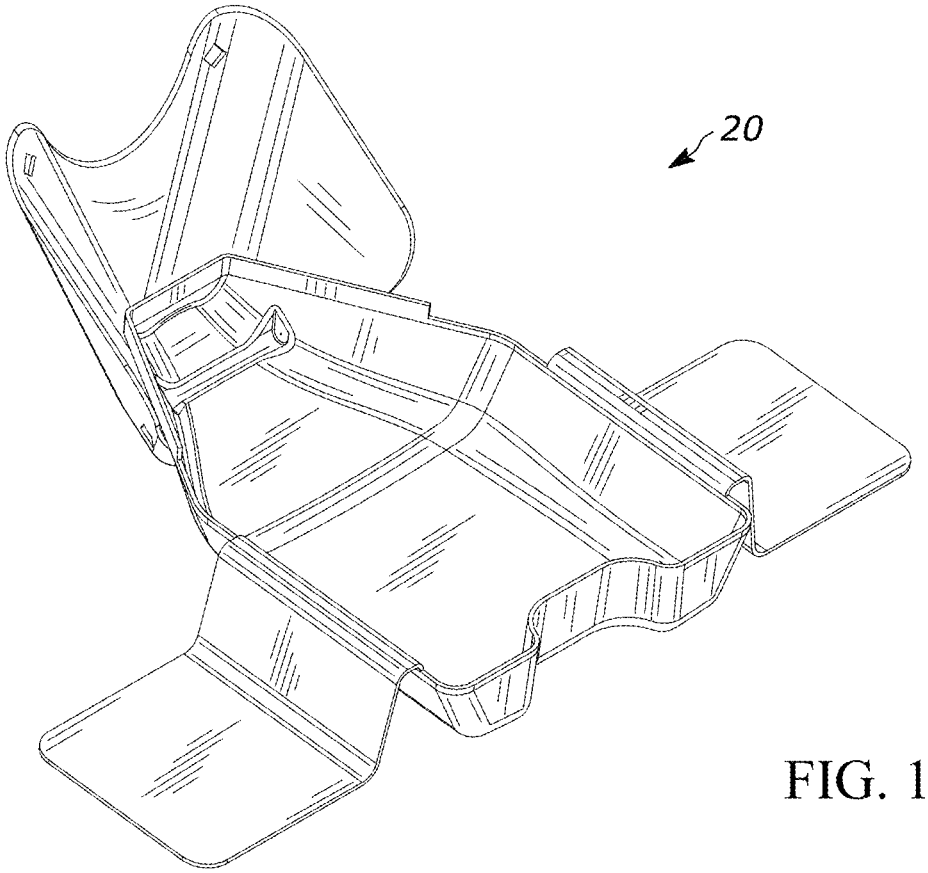
FIG. 19 is a top left perspective view thereof.
Figure 20:
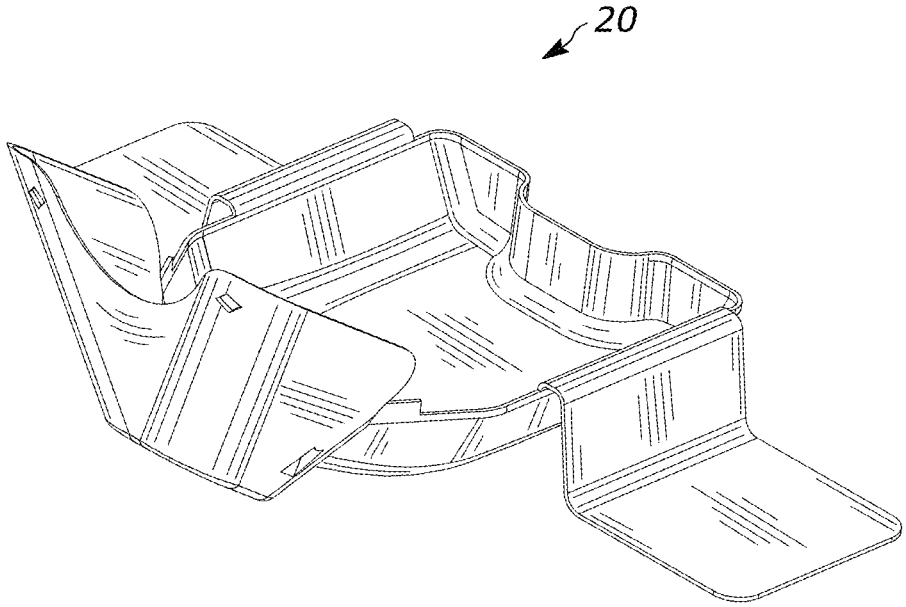
FIG. 20 is a top right perspective view thereof.
Figure 21:
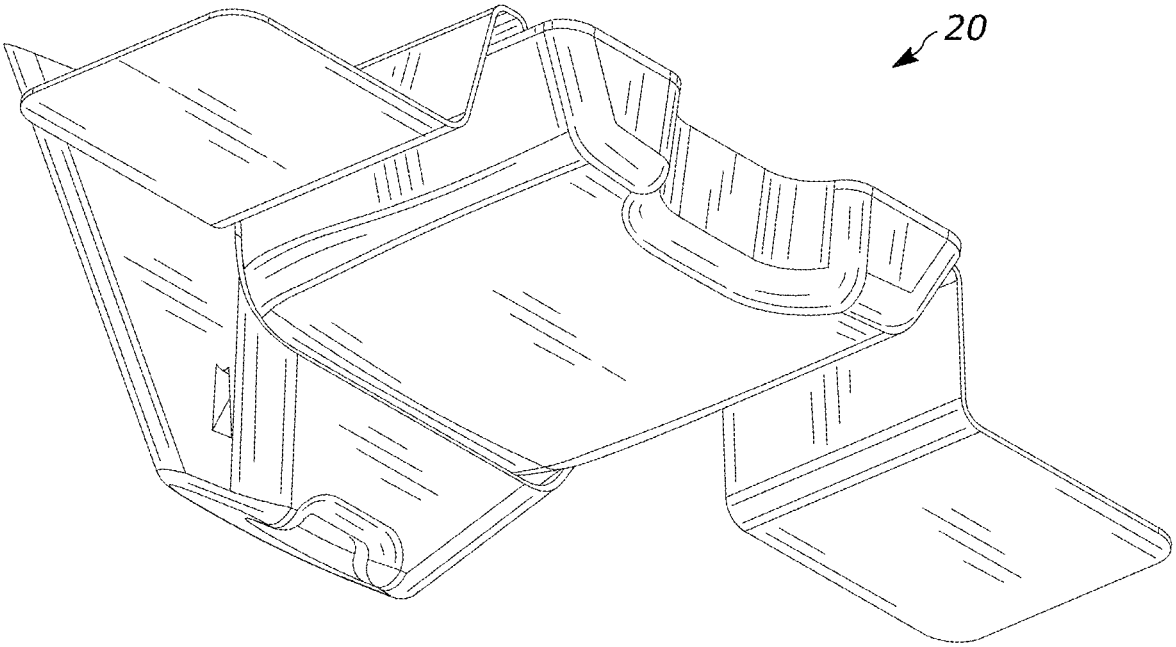
FIG. 21 is a bottom left perspective view thereof.
Figure 22:
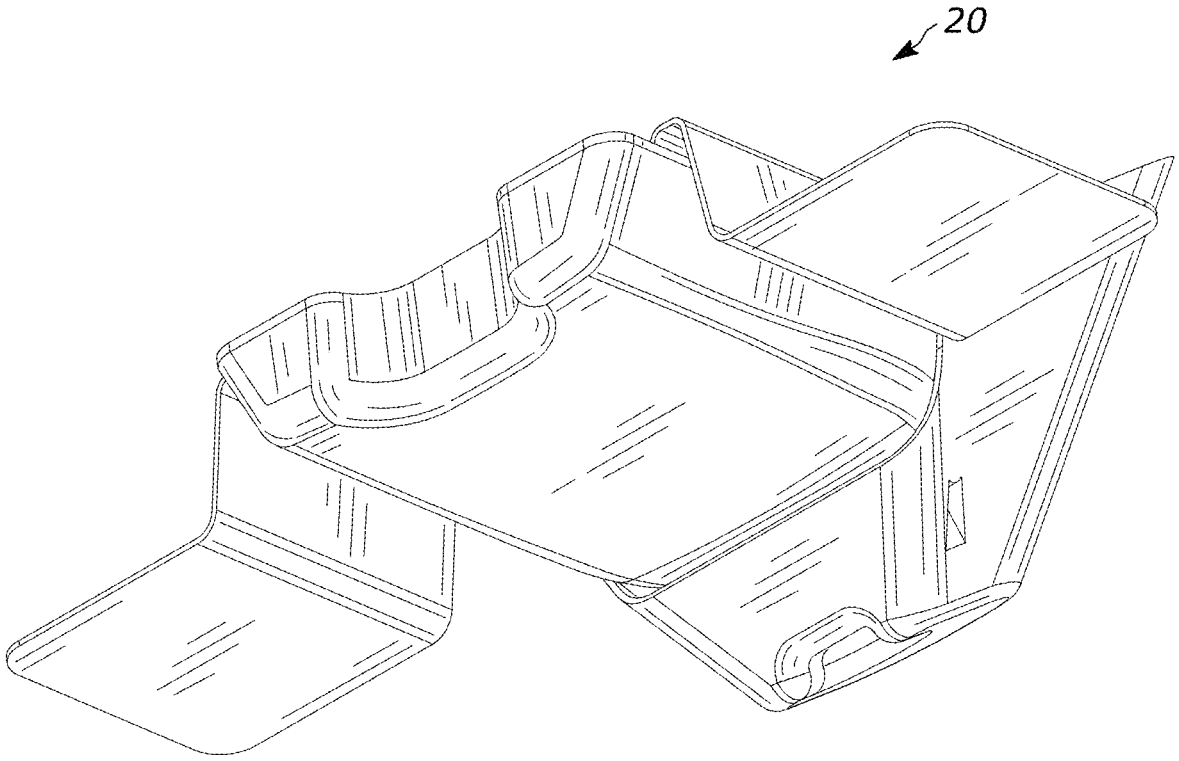
FIG. 22 is a bottom right perspective view thereof.
Figure 23:
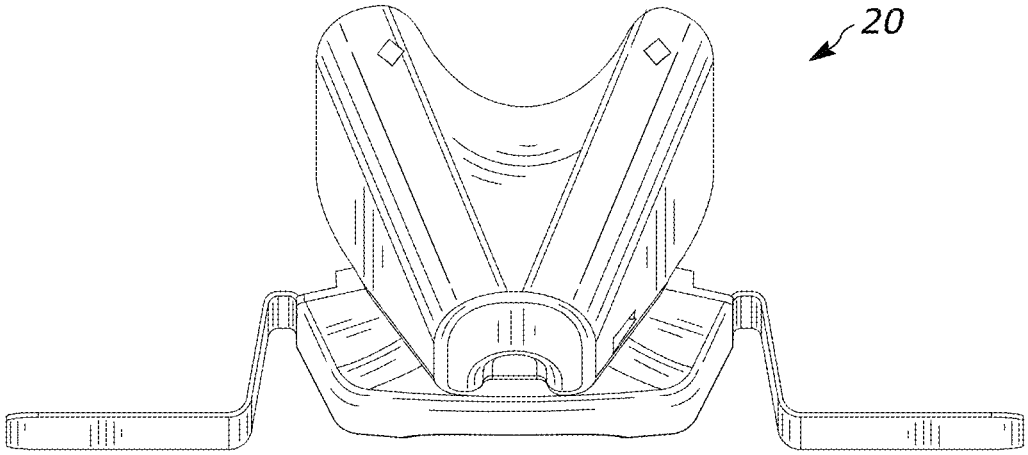
FIG. 23 is a front elevation view thereof.
Figure 24:
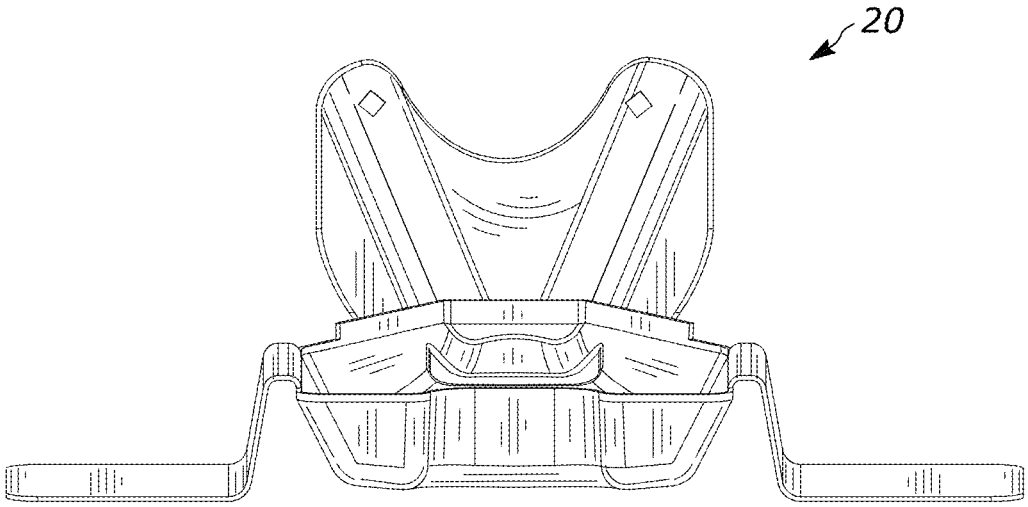
FIG. 24 is a rear elevation view thereof.
Figure 25:
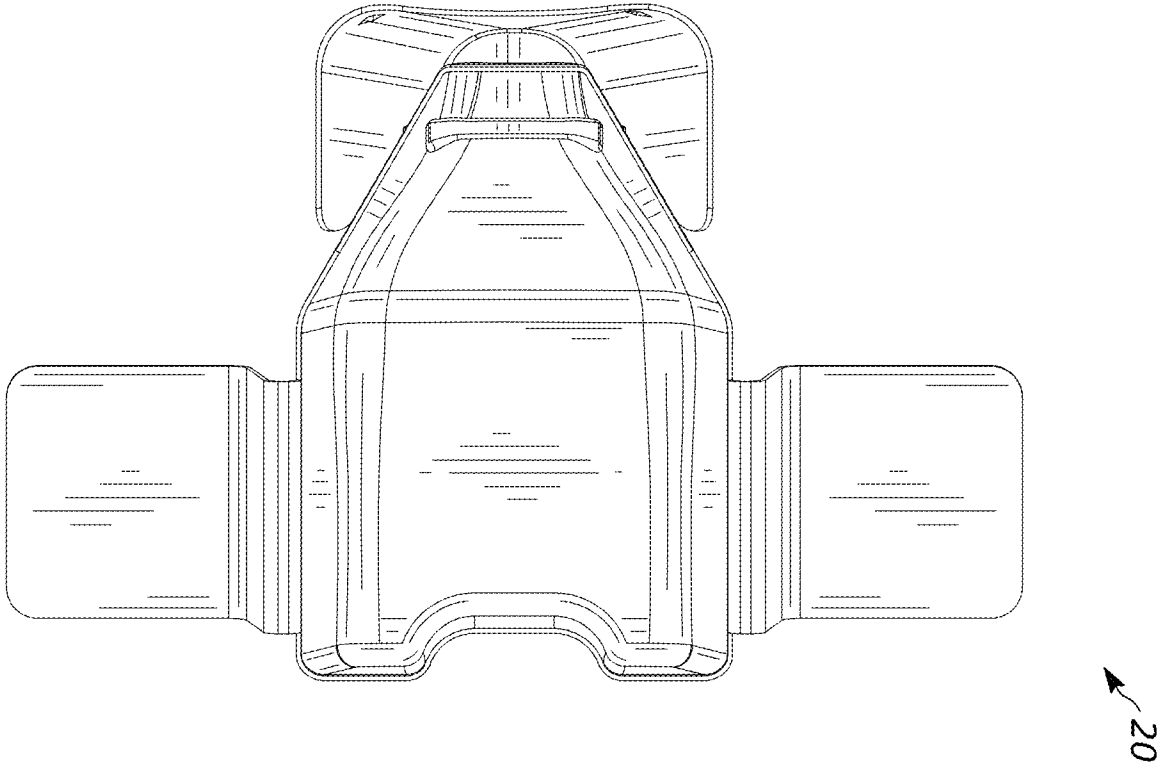
FIG. 25 is a top plan view thereof.
Figure 26:
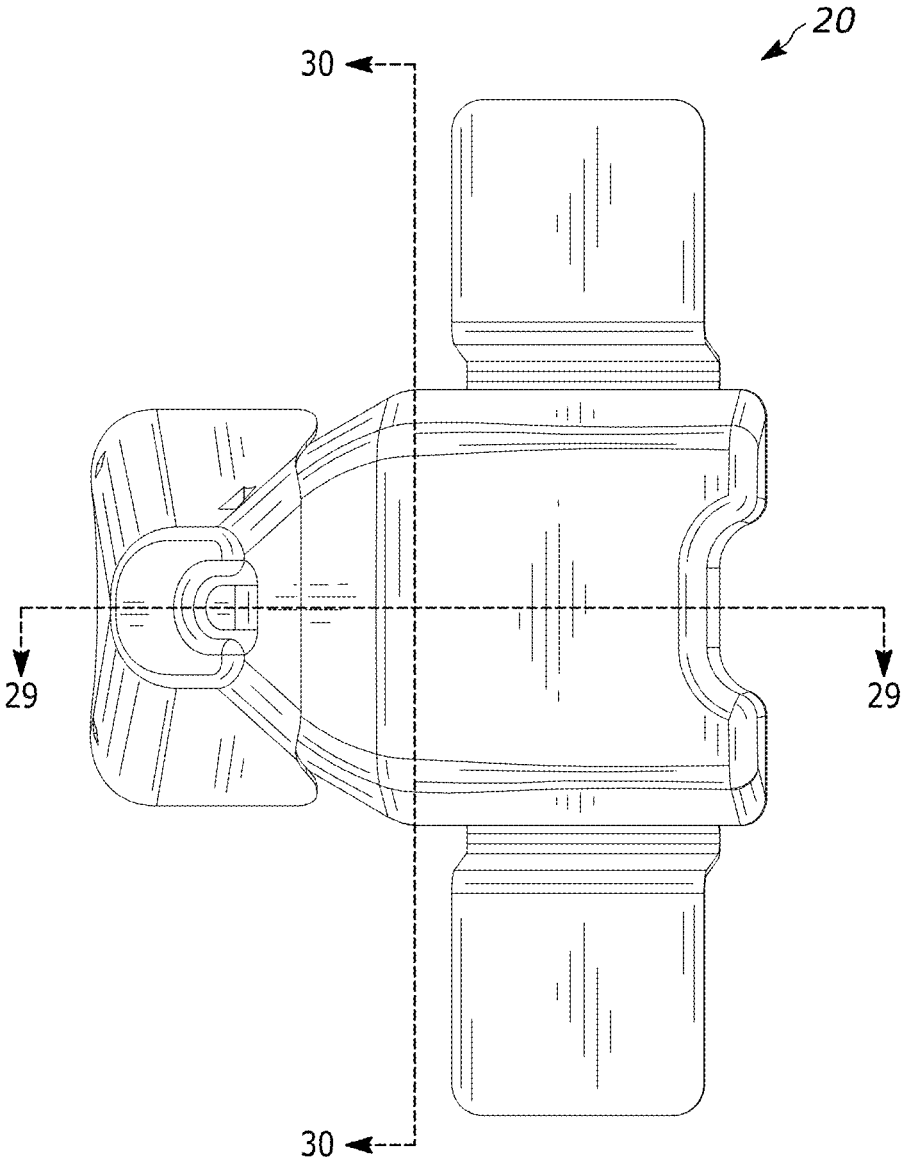
FIG. 26 is a bottom plan view thereof.
Figure 27:
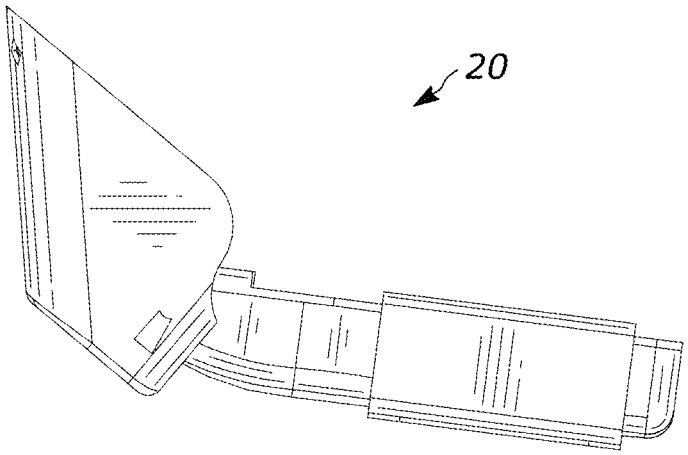
FIG. 27 is a left side elevation view thereof.
Figure 28:
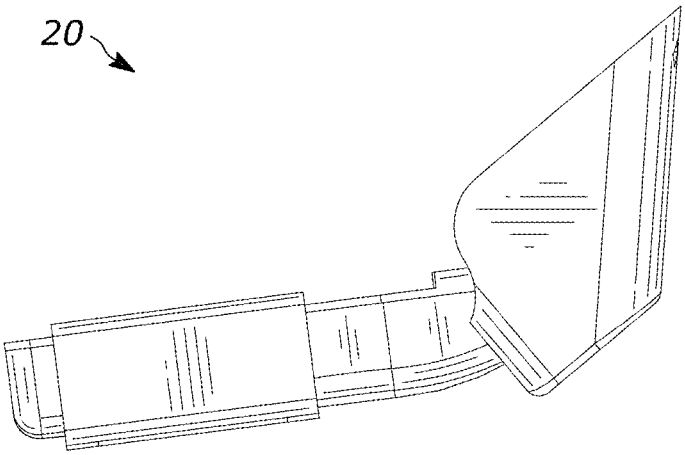
FIG. 28 is a right side elevation view thereof.
Figure 29:
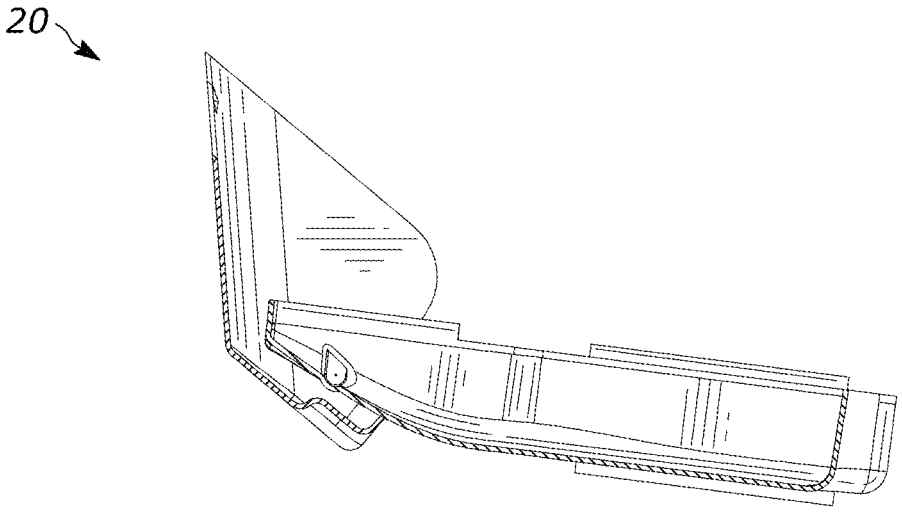
FIG. 29 is a cross-section of a left side elevation view thereof taken along lines 29-29 of FIG. 26.
Figure 30:
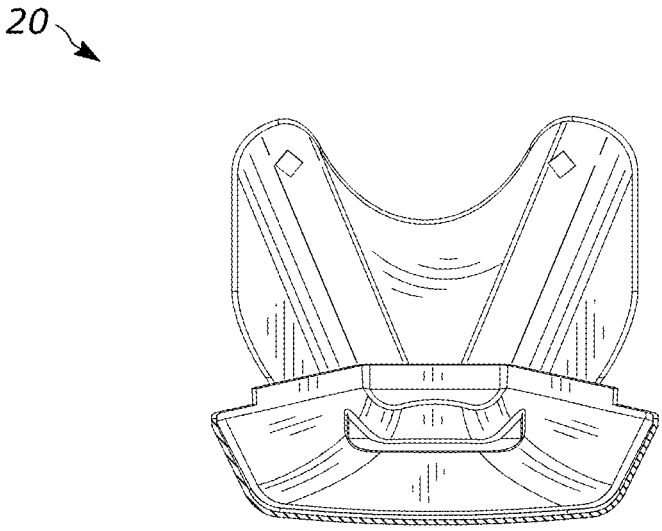
FIG. 30 is a cross-section of a rear elevation view thereof taken along lines 29-29 of FIG. 26.
Figure 31:
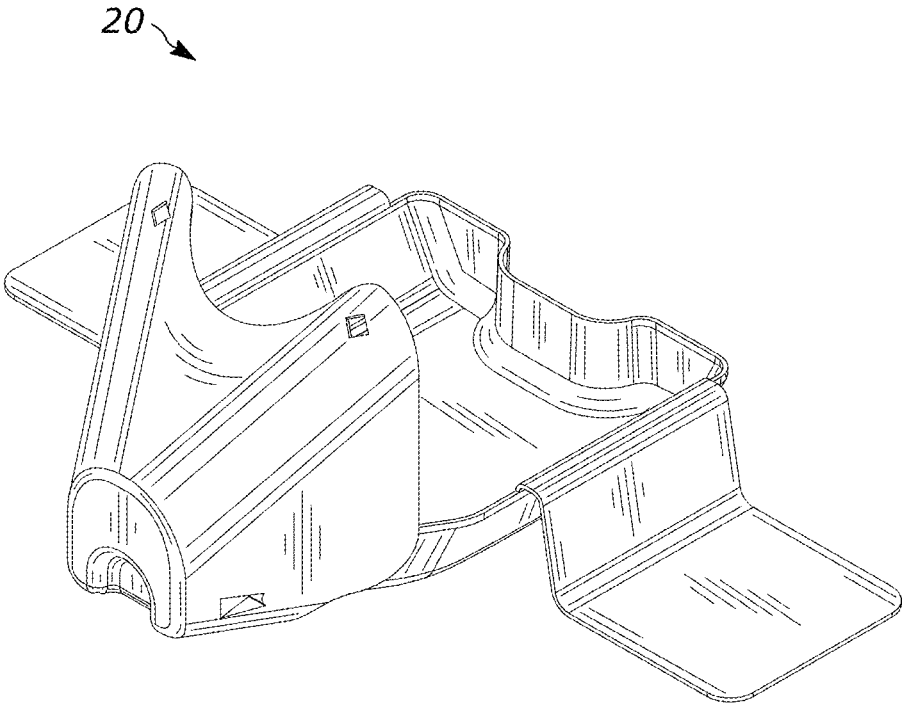
FIG. 31 is a top left perspective view of a MICRO-SPILL PREVENTION TROUGH in a closed position in accordance with one example embodiment of the present disclosure.

In the illustrated example embodiments of FIGS. 8-10, 15-16 the fluid retaining portion 60 is rotationally moved toward, the attachment portion 40 in direction A (see FIG. 9) into the closed position 20*b*. As illustrated in FIG. 15, in the closed position 20*b*, the front wall 72*c* pivots into contact with the flat bottom surface 51 of the attachment portion 40 and exterior portions of the first and second sidewalls 72*a*, 72*b* move into contact with interior portions of the wall 47. Further, in the closed position 20*b*, the first and second edges 47*a*, 47*b* of the wall 47 of the attachment portion 40 align with the first and second sidewalls 72*a*, 72*b* of the fluid retaining portion 60.

As shown in the example embodiment of FIG. 8, an attachment angle 83 at which the first and second edges 47*a*, 47*b* extend away from the flat bottom surface 51 is complementary to a retaining angle 81. Edges of the first and second sidewalls 72*a*, 72*b*, comprised in the flow direction path 68, extend along the retaining angle 81 from the front wall 72*c* toward the rear wall 72*d* (see for example, FIG. 8). As illustrated in the example embodiment of FIG. 9, the complementary nature of the attachment angle 83 and the retaining angle 81 creates a fluid retention container 88. The fluid retention container 88 is defined by the flat bottom surface 50, and the wall 47 of the attachment portion, and the front wall 72*c*, the first and second sidewalls 72*a*, 72*b*, and the base wall 70.

Responsive to fluid being preset in the fluid retaining portion 60 when the fluid retaining portion is rotationally moved toward the attachment portion 40 in direction A, the fluid will travel from the fluid retaining portion into the bucket portion 52 of the attachment portion 40, until the micro-spill prevention trough 20 is in the closed position 20*b*, wherein the fluid is retained in the fluid retention container 88. In one example embodiment, the interaction of the wall 47 of the attachment portion 40 and the first and second sidewalls 72*a*, 72*b* of the fluid retaining portion 60 frictionally maintains the micro-spill prevention trough 20 in the closed position 20*b* absent application of a force over a force threshold. In another example embodiment illustrated in FIG. 8, the first and second protrusions 51*a*, 51*b* frictionally interact with the first and second voids 84*a*, 84*b* to maintain the micro-spill prevention trough 20 in the closed position 20*b* absent application of a force over a force threshold. Responsive to capturing fluid in the micro-spill prevention trough 20, the micro-spill prevention trough is moved into the closed position 20*b*, and the micro-spill prevention trough is removed from the tote 10, wherein the fluid is safely disposed of, and safely retained in the fluid retention container 88.

The micro-spill prevention trough 20 advantageously is configured to interact with most IBC totes 10 and prevents micro-spills or drips of various chemicals without having to purchase additional totes. Further, the micro-spill prevention trough 20 has the closed position 20*b* wherein the micro-spill prevention trough is within the bounds of the IBC tote 10, such that the micro-spill prevention trough is transportable with the tote. Stated another way, in the closed position 20*b*, the micro-spill prevention trough 20 is clear from contact of any fork truck or fork truck rakes used to move the tote 10. Thus, breakage of the micro-spill prevention trough is advantageously minimized. Additionally, as the micro-spill prevention trough 20 forms a fluid retention container 88 in the closed position 20*b*, fluids can be sequestered and spilling is minimized.

Figure 32:
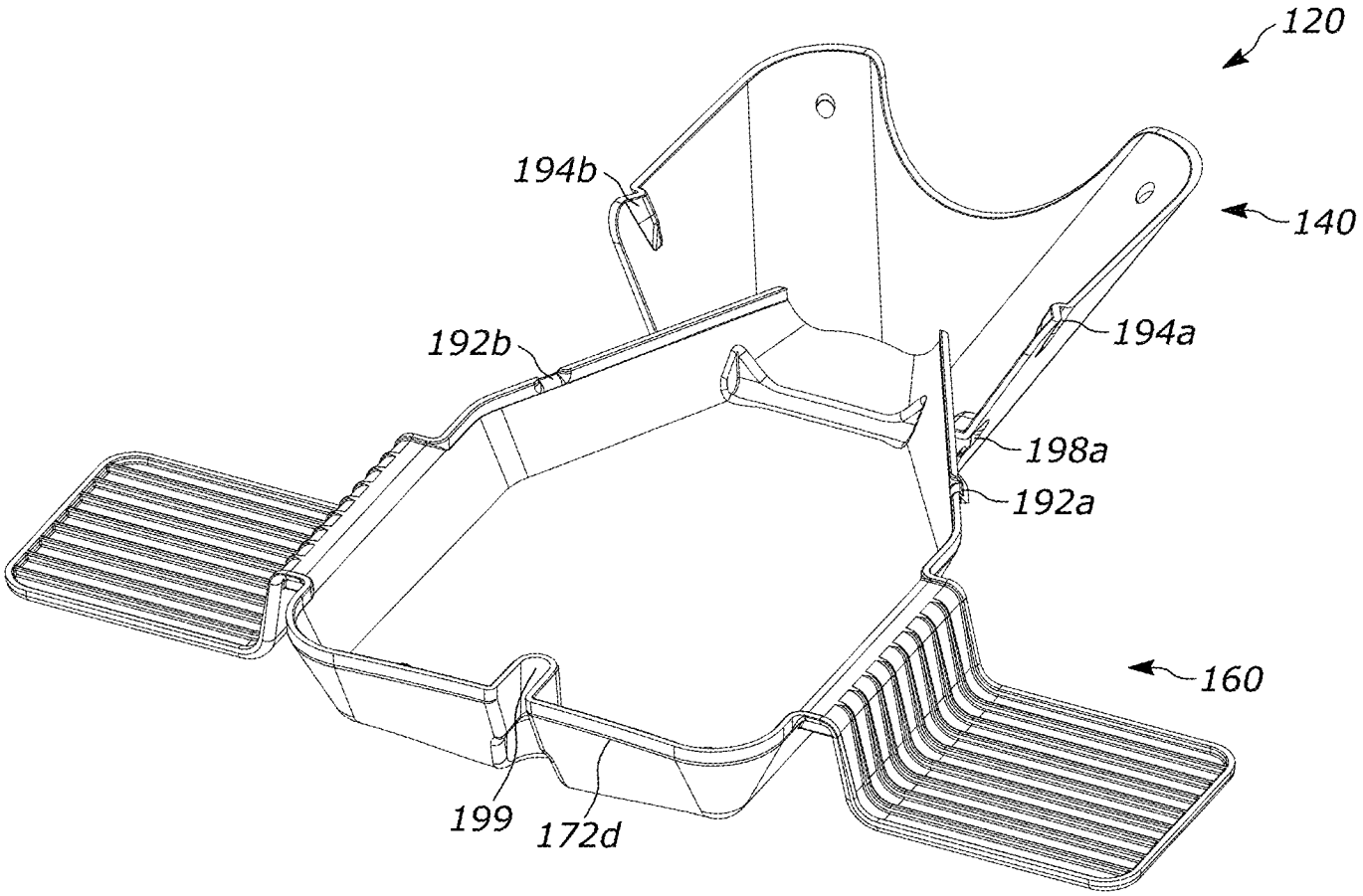
FIG. 32 is a rear perspective view of a spill prevention trough in an open position in accordance with a second example embodiment of the present disclosure.
Figure 33:
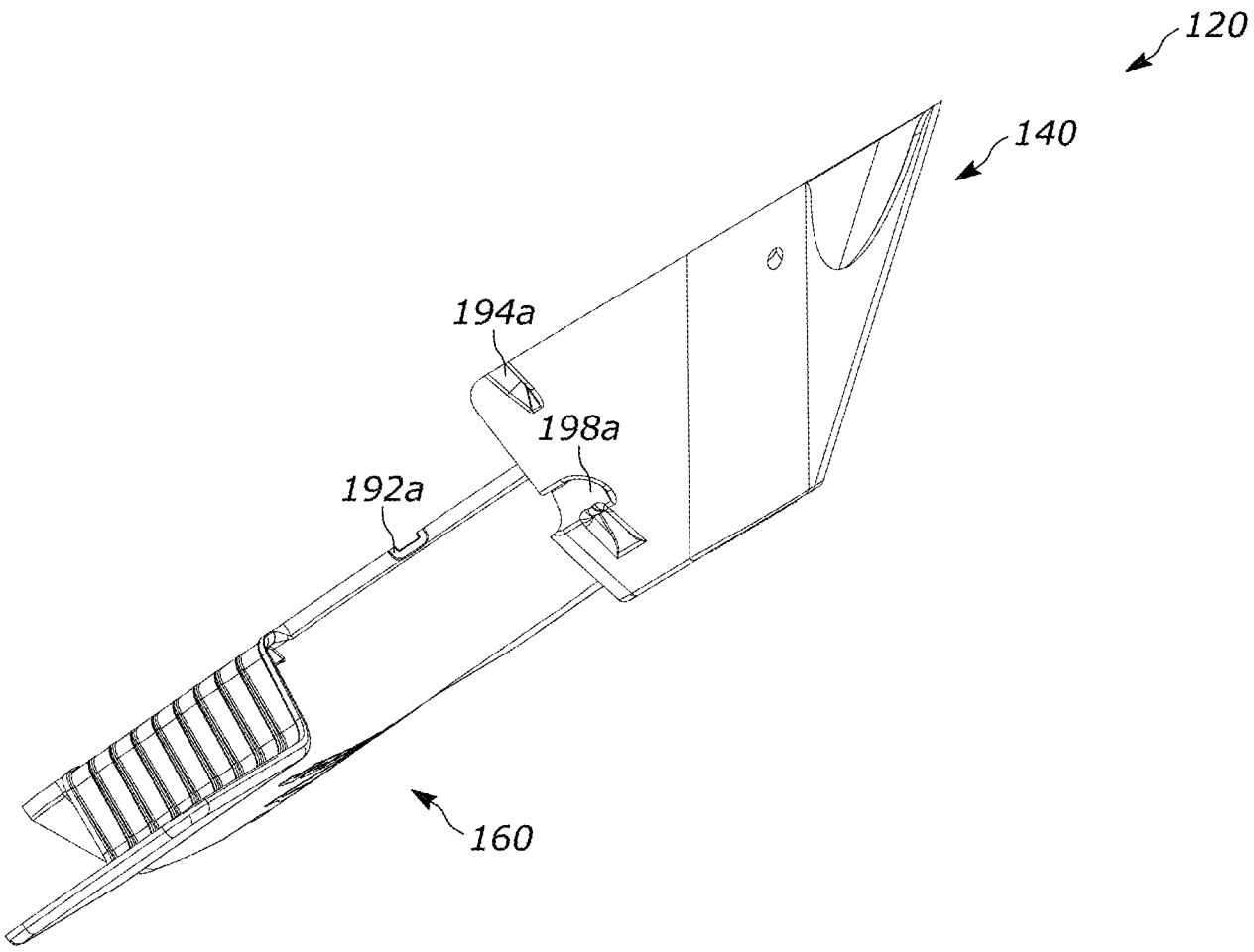
FIG. 33 is a side perspective view of a spill prevention trough in an open position in accordance with a second example embodiment of the present disclosure Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

Referring now to FIGS. 32-33, another example embodiment of a micro-spill prevention trough 120 is shown. Features of the micro-spill prevention trough 120 illustrated in FIGS. 32-33 that are similar to the features of the micro-spill prevention trough 20 illustrated in FIGS. 2-31 will be identified by like numerals increased by a factor of one-hundred.

In the illustrated example embodiment of FIGS. 32-33, the attachment portion 140 includes first and second indents 194*a*, 194*b*. The first and second indents 194*a*, 194*b* interact with first and second lips 192*a*, 192*b* defined by the fluid retaining portion 160 in the closed position. In one example embodiment, the first and second indents 194*a*, 194*b* interact frictionally with the first and second lips 192*a*, 192*b*. In another example embodiment, the first and second indents 194*a*, 194*b* slip onto the first and second lips 192*a*, 192*b*, such that to re-open the micro-spill prevention trough 120, the attachment portion 140 is flexed inwardly to unclip the lips from the indents.

As illustrated in the example embodiment of FIG. 33, the attachment portion 140 defines a relief projection 198*a* for ease of manufacturing Ic. A second relief projection is on a second side of the attachment portion 140 (not shown) opposite the relief projection 198*a*. In the illustrated example embodiment, the fluid retaining portion 160 includes a rear notch 199. In one example embodiment, the rear notch 199 comprises a u-shaped indent in the rear wall 172*d*.

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. In one non-limiting embodiment the terms are defined to be within for example 10%, in another possible embodiment within 5%, in another possible embodiment within 1%, and in another possible embodiment within 0.5%. The term "coupled" as used herein is defined as connected or in contact either temporarily or permanently, although not necessarily directly and not necessarily mechanically. A device or structure that is "configured" in a certain way is configured in at least that way, but may also be configured in ways that are not listed.

To the extent that the materials for any of the foregoing embodiments or components thereof are not specified, it is to be appreciated that suitable materials would be known by one of ordinary skill in the art for the intended purposes.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A micro-spill prevention trough for use with intermediate bulk container (IBC) totes comprising:

an attachment portion configured to be secured under a spout of an intermediate bulk container (IBC) tote, the attachment portion comprising a bucket portion defining a fluid retention space; and a fluid retaining portion defining a second fluid retention space rotationally coupled to the attachment portion, wherein the fluid retaining portion pivots between an open position and a closed position, wherein in the closed position a front wall of the fluid retaining portion pivots into the bucket portion of the attachment portion to define a fluid retention container.

2. The micro-spill prevention trough of claim 1, wherein the fluid retaining portion comprises a flow direction path that directs fluid from the fluid retaining portion into the bucket portion in the closed position.

3. The micro-spill prevention trough of claim 1, wherein in the closed position the fluid retaining portion resides within a plane defining a front face of the IBC tote.

4. The micro-spill prevention trough of claim 1, wherein the attachment portion is coupled to the IBC tote by a securing apparatus.

5. The micro-spill prevention trough of claim 4, wherein the securing apparatus comprises a tightening portion that frictionally and removably couples the attachment portion to the IBC tote.

6. The micro-spill prevention trough of claim 1, wherein the bucket portion comprises an interface lip, wherein the interface lip interacts with the fluid retaining portion to further define a flow direction path.

7. The micro-spill prevention trough of claim 1, wherein the bucket portion comprises a substantially flat bottom surface.

8. The micro-spill prevention trough of claim 7, wherein the substantially flat bottom surface extends along a first axis that is parallel to a surface on which the IBC tote rests when in use.

9. The micro-spill prevention trough of claim 1, wherein the attachment portion compromises a wall that increases in height as the wall extends away from the bucket portion, the wall defining an interior space of the attachment portion.

10. The micro-spill prevention trough of claim 9, wherein the attachment portion defining a spout engagement notch configured to interact with an underside of an outlet port comprising the spout of the IBC tote, such that portions of the wall extend beyond a drip location of the outlet port.

11. The micro-spill prevention trough of claim 1, wherein the fluid retaining portion comprises a capture area defined by a base wall, first and second sidewalls, a front wall, and a rear wall.

12. The micro-spill prevention trough of claim 11, wherein the fluid retaining portion defines a flow direction path, wherein the flow direction path is defined by portions of the front wall, the base wall, and the first and second sidewalls.

13. The micro-spill prevention trough of claim 11, wherein the fluid retaining portion defines a flow direction path, wherein the flow direction path comprises an area wherein the base wall begins to narrow to as it extends toward the front wall.

14. The micro-spill prevention trough of claim 11, wherein the first and second sidewalls are coupled to wing supports, wherein the wing supports support first and second wings.

15. The micro-spill prevention trough of claim 11, wherein the front wall and at least a portion of sidewalls of the fluid retaining portion are located over the attachment portion in the open position, wherein, responsive to a fluid overflowing the front wall, the liquid is retained within the bucket portion.

16. The micro-spill prevention trough of claim 11, wherein portions of first and second edges of a wall of the attachment portion are adjacent to the first and second sidewalls of the fluid retaining portion in the closed position.

17. A method of making a micro-spill prevention trough for use with intermediate bulk container (IBC) totes, the method comprising the steps of:

providing an attachment portion configured to be secured under a spout of an intermediate bulk container (IBC) tote;

providing a bucket portion defining a fluid retention space within the attachment portion;

providing a fluid retaining portion having a front wall defining a second fluid retention space; and rotationally coupling to the attachment portion to the fluid retaining portion such that the fluid retaining portion pivots between an open position and a closed position, wherein in the closed position the front wall of the fluid retaining portion pivots into the bucket portion of the attachment portion to define a fluid retention container.

18. The method of claim 17, the providing a fluid retaining portion comprising forming a flow direction path, wherein the flow direction path directs fluid from the fluid retaining portion into the bucket portion in the closed position.

19. A micro-spill prevention trough for use with intermediate bulk container (IBC) totes comprising:

an attachment portion configured to be secured under a spout of an intermediate bulk container (IBC) tote, wherein the attachment portion compromises:

a bucket portion defining a fluid retention space, wherein the bucket portion comprises an interface lip; and a wall having a variable height as the wall extends away from the bucket portion, the wall defining an interior space of the attachment portion;

a fluid retaining portion defining a second fluid retention space, the fluid retaining portion comprising:

a capture area defined by a base wall, first and second sidewalls, a front wall, and a rear wall; and a flow direction path, wherein the flow direction path is defined by portions of the front wall, the base wall, and the first and second sidewalls; and the fluid retaining portion rotationally coupled to the attachment portion, wherein the fluid retaining portion pivots between an open position and a closed position, in the closed position the front wall of the fluid retaining portion pivots into the bucket portion of the attachment portion to define a fluid retention container, wherein the interface lip interacts with the fluid retaining portion to further define the flow direction path.

20. The micro-spill prevention trough of claim 19, wherein responsive to the fluid retaining portion being in the open position, the front wall and at least a portion of sidewalls of the fluid retaining portion are located over the attachment portion, and, responsive to the fluid retaining portion being in the closed position, portions of first and second edges of a wall of the attachment portion are adjacent to the first and second sidewalls of the fluid retaining portion.

* * * * *